US011180939B2

(12) United States Patent
Jeffries

(10) Patent No.: US 11,180,939 B2
(45) Date of Patent: Nov. 23, 2021

(54) SLIDING CLOSURE FOR CABINETS

(71) Applicant: Austin Hardware & Supply, Inc., Lee's Summit, MO (US)

(72) Inventor: Mark Steven Jeffries, Buford, GA (US)

(73) Assignee: Austin Hardware and Supply, Inc., Lee's Summit, MO (US)

( * ) Notice: Subject to any disclaimer, the term of this patent is extended or adjusted under 35 U.S.C. 154(b) by 91 days.

(21) Appl. No.: 16/296,675

(22) Filed: Mar. 8, 2019

(65) Prior Publication Data

US 2019/0277075 A1 Sep. 12, 2019

Related U.S. Application Data

(60) Provisional application No. 62/640,748, filed on Mar. 9, 2018.

(51) Int. Cl.

| | |
|---|---|
| ***E05D 15/08*** | (2006.01) |
| ***E05D 15/12*** | (2006.01) |
| ***E05D 15/06*** | (2006.01) |
| *E05B 65/08* | (2006.01) |

(52) U.S. Cl.

CPC ..... *E05D 15/08* (2013.01); *E05D 15/0647* (2013.01); *E05D 15/0682* (2013.01); *E05D 15/0686* (2013.01); *E05D 15/12* (2013.01); *E05B 65/0811* (2013.01); *E05Y 2900/20* (2013.01)

(58) Field of Classification Search

CPC . E05D 15/08; E05D 15/0686; E05D 15/0647; E05D 15/0682

See application file for complete search history.

(56) References Cited

U.S. PATENT DOCUMENTS 3,250,063 A * 5/1966 Andrews ..... B01D 46/0013 55/483
3,774,342 A * 11/1973 Thom ..... E05D 15/066 49/420
3,852,916 A * 12/1974 Laby ..... E05D 15/0634 49/409
4,395,847 A * 8/1983 Atchison ..... E06B 3/42 292/DIG. 46
6,131,340 A * 10/2000 Clark ..... B63B 43/24 114/202
9,441,405 B2 * 9/2016 Chubb ..... E05D 15/0686
(Continued)

FOREIGN PATENT DOCUMENTS

CA 2306137 A1 * 10/2000 ..... E05D 15/0682

*Primary Examiner* — Marcus Menezes
(74) *Attorney, Agent, or Firm* — Polsinelli PC

(57) ABSTRACT

A frame assembly with sliding panels is described. The frame assembly includes a frame having an upper section opposite of a lower section. The lower section of the frame defines a first channel and a second channel. A first sliding panel includes a first lower edge. A first panel support is removably engaged to the first lower edge. The first panel support includes a first holding member that engages to the first lower edge. The first panel support slides in the first channel. A second sliding panel includes a second lower edge. A second panel support is removably engaged to the second lower edge. The second panel support includes a second holding member that engages to the second lower edge. The second panel support slides in the second channel.

23 Claims, 15 Drawing Sheets

(56) References Cited

U.S. PATENT DOCUMENTS

2005/0230068 A1* 10/2005 Green ..... E06B 3/4609
160/371
2010/0192468 A1* 8/2010 Chubb ..... E06B 7/2314
49/407
2010/0242365 A1* 9/2010 Langner ..... E05D 15/0686
49/130
2018/0073290 A1* 3/2018 Jeffries ..... E05D 15/08

* cited by examiner

SLIDING CLOSURE FOR CABINETS

This applications claims priority to U.S. Provisional Patent Application 62/640,748 filed Mar. 9, 2018, which is hereby incorporated by reference.

FIELD OF INVENTION

The present invention relates to sliding closures for cabinets.

SUMMARY

Frames are used to cover a front of a cabinet and to selectively open and close the cabinet. The frames may include sliding closures or panels to cover an opening of the cabinet. The frames may further include a hinged door to cover the opening of the cabinet. The frames may further include a combination hinged door with sliding closures or panels to cover the opening of the cabinet—commonly called a restocking closure. The cabinet and frame described herein are well suited for use on emergency vehicles, such as ambulance, fire trucks, etc. The cabinets and frame may be used for storage on such vehicles. The frames with sliding closures or panels and/or hinged doors may be used close the cabinets and prevent the contents of the cabinet from falling out of the cabinet. Such frames are also described in US Patent Publication 2018/0073290, which is hereby incorporated by reference.

The cabinets may further include the frame with the restocking closure, which includes the hinged door with built-in sliding closures. This allows for the cabinet to be completely opened for restocking the cabinet, and also allows the cabinet to be accessed by sliding the closures, such as Plexiglas panels, to an open position for immediately retrieve items from the cabinet.

The frame may hold a first panel and a second panel in a sliding engagement. The first panel may slide in front of the second panel and/or the second panel may slide behind the first panel. The first panel and second panel are mounted to panel supports. The panel supports allow the panels to be easily removed from the frame. The panel supports may be disengaged from a top or a bottom edge of the panel by actuating a holding member of the panel support, such as a leaf spring or other biasing member of the holding member. This allows the panel supports to be moved laterally with respect to the frame—and off of the top or bottom edges of the panel.

When the panel support is first removed from the top edge, the panel may be lifted upward. The panel may be lifted upward into the upper channel, since the panel support has been moved. With the panel lifted upward, the bottom of the panel may be tilted outward.

When the panel support is first removed from the bottom edge, the bottom edge of the panel has no support and may be moved downward to rest directly on the bottom surface of the channel. This in turn moves a top edge of the panel downward in an upper channel which disengages the top edge with the panel supports in the upper channel and allows that top edge to be positioned below the confines of the upper channel. From this unrestrained position, the panel may be tilted forward or aft and removed from the frame. This removability is especially useful when a panel has become scratched, damaged, etc.

The panel supports may be provided in different lengths to support different length panels. In certain aspects, panel supports may be used only on the top or the bottom edges of the panels.

In one aspect, a frame assembly with sliding panels is described. The frame assembly includes a frame having an upper section opposite of a lower section. The lower section of the frame defines a first lower channel and a second lower channel. The upper section of the frame defines a first upper channel and a second upper channel. A first sliding panel includes a first lower edge and a first panel support removably engaged to the first lower edge. The first panel support includes a first holding member that engages to the first lower edge. The first panel support slides in the first lower channel. The first sliding panel includes a first upper edge and a second panel support removably engaged to the first upper edge. The second panel support includes a second holding member that engages to the first upper edge. The first panel support slides in the first upper channel. A second sliding panel includes a second lower edge and a third panel support removably engaged to the second lower edge. The second panel support includes a third holding member that engages to the second lower edge. The third panel support slides in the second lower channel. The second sliding panel includes a second upper edge and a fourth panel support removably engaged to the second upper edge. The second panel support includes a fourth holding member that engages to the second upper edge. The fourth panel support slides in the second upper channel.

In another aspect, a frame assembly with a sliding panel is described. The frame assembly includes a frame having an upper section opposite of a lower section. The lower section of the frame includes a lower channel. The upper section of the frame includes an upper channel. A sliding panel includes a lower edge and an upper edge. A panel support includes a holding member that removably engages to the lower edge or the upper edge of the panel. The panel support slides in the upper channel or the lower channel.

In another aspect, a method of removing a sliding panel from a frame is described. The method includes providing a frame with a sliding panel. The frame includes an upper section opposite of a lower section. The lower section of the frame includes a lower channel. The upper section of the frame includes an upper channel. A sliding panel includes a lower edge and an upper edge. An upper panel support includes a first holding member that removably engages to the upper edge of the panel. A lower panel support includes a second holding member that removably engages to the lower edge of the panel. The upper panel support slides in the upper channel and the lower panel support slides in the lower channel. The method includes disengaging the first holding member of the upper panel support from the upper edge of the panel. The method includes sliding the panel support away from the upper edge of the panel. The method includes lifting the panel upward. The method includes tilting a bottom portion of the sliding panel outward from the lower section and removing the panel from the frame.

In one aspect, a frame assembly with sliding panels is described. The frame assembly includes a frame having an upper section opposite of a lower section. The lower section of the frame defines a first channel and a second channel. A first sliding panel includes a first lower edge. A first panel support is removably engaged to the first lower edge. The first panel support includes a first holding member that engages to the first lower edge. The first panel support slides in the first channel. A second sliding panel includes a second lower edge. A second panel support is removably engaged to the second lower edge. The second panel support includes a second holding member that engages to the second lower edge. The second panel support slides in the second channel.

In another aspect, a frame assembly with a sliding panel is described. The frame includes an upper section opposite of a lower section. The lower section of the frame includes a channel. The frame assembly includes a sliding panel having a lower edge. The frame assembly includes a panel support having a holding member that removably engages to the lower edge of the panel. The panel support slides in the channel.

In another aspect, a panel support for a sliding panel is described. The panel support includes a central wall, a first sidewall generally perpendicular to the central wall, and a second sidewall generally perpendicular to the central wall. The first and second sidewalls define a first channel configured to receive an edge of a sliding panel. The first and second sidewalls define a second channel. A holding member is positioned in the second channel.

In another aspect, a method of replacing a sliding panel in a frame is described. The method includes providing a frame having an upper section opposite of a lower section and a left section opposite of a right section. The lower section of the frame defines a channel. A sliding panel includes a lower edge. One or more panel supports are removably engaged to the lower edge by a spring portion. The one or more panel supports slide in the channel, and an overall height of the sliding panel and the panel supports maintain the sliding panel in the frame. The method includes disengaging the panel supports from the sliding panel. The method includes moving the sliding panel off of the panel supports, wherein the panel has a height which is less than a height of the frame. The method includes removing the sliding panel from the frame.

In another aspect, a method of replacing sliding panels in a frame is described. The method includes providing a frame having an upper section opposite of a lower section and a left section opposite of a right section. The lower section of the frame defines a first channel and a second channel. A first sliding panel includes a first lower edge. One or more panel supports are removably engaged to the first lower edge by a leaf spring. The one or more panel supports slide in the first channel. A second sliding panel includes a second lower edge. One or more panel supports are removably engaged to the second lower edge by a leaf spring. The one or more panel supports slide in the second channel. The method includes disengaging the panel supports from the first and second panels. The method includes moving the panel supports laterally until the panel supports are not under the first and second panels. The method includes removing the first and second panels out of the frame.

In another aspect, a method of replacing a sliding panel in a frame is described. The method includes providing a frame having an upper section opposite of a lower section and a left section opposite of a right section. The lower section of the frame defines a channel. A sliding panel includes a lower edge. One or more panel supports are removably engaged to the lower edge by a leaf spring. The one or more panel supports slide in the channel, and an overall height of the sliding panel and the panel supports maintains the sliding panel in the frame. The method includes disengaging the panel supports from the sliding panel. The method includes moving the panel supports laterally until the panel supports are not under the sliding panel. The method includes removing the sliding panel from the frame.

DETAILED DESCRIPTION OF INVENTION

Figure 1:
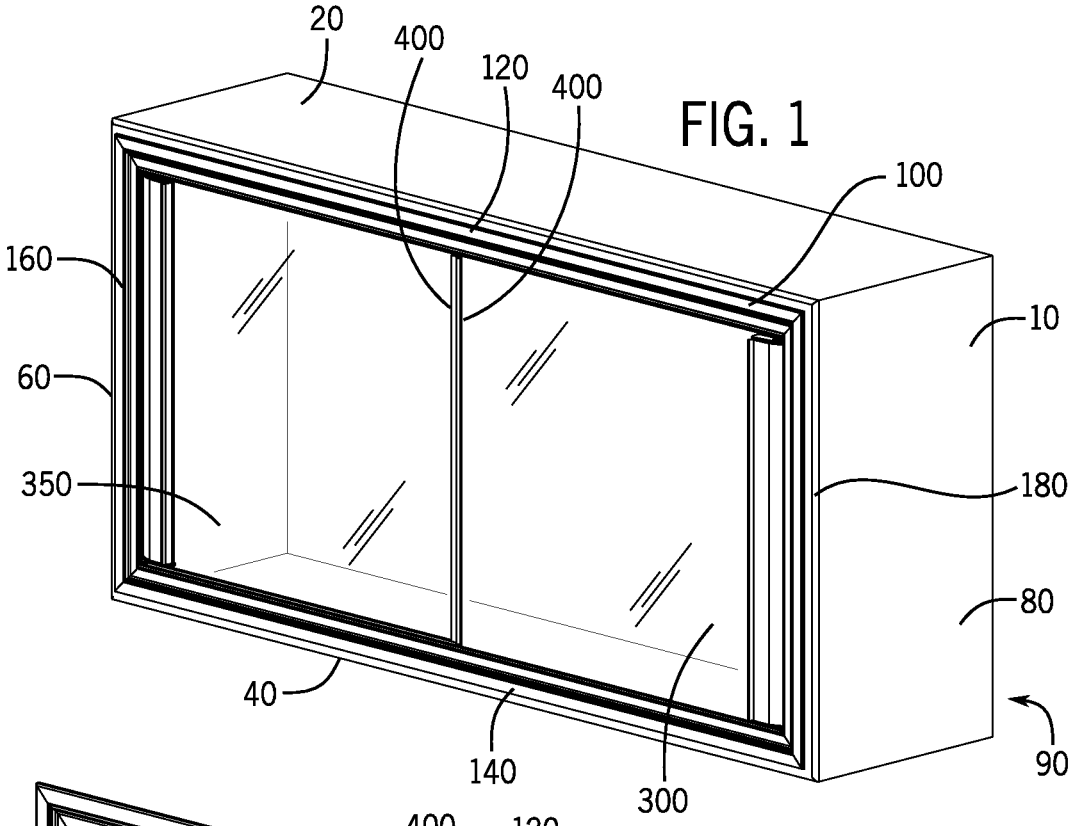
FIG. 1 is a perspective view of the cabinet and frame.
Figure 2:
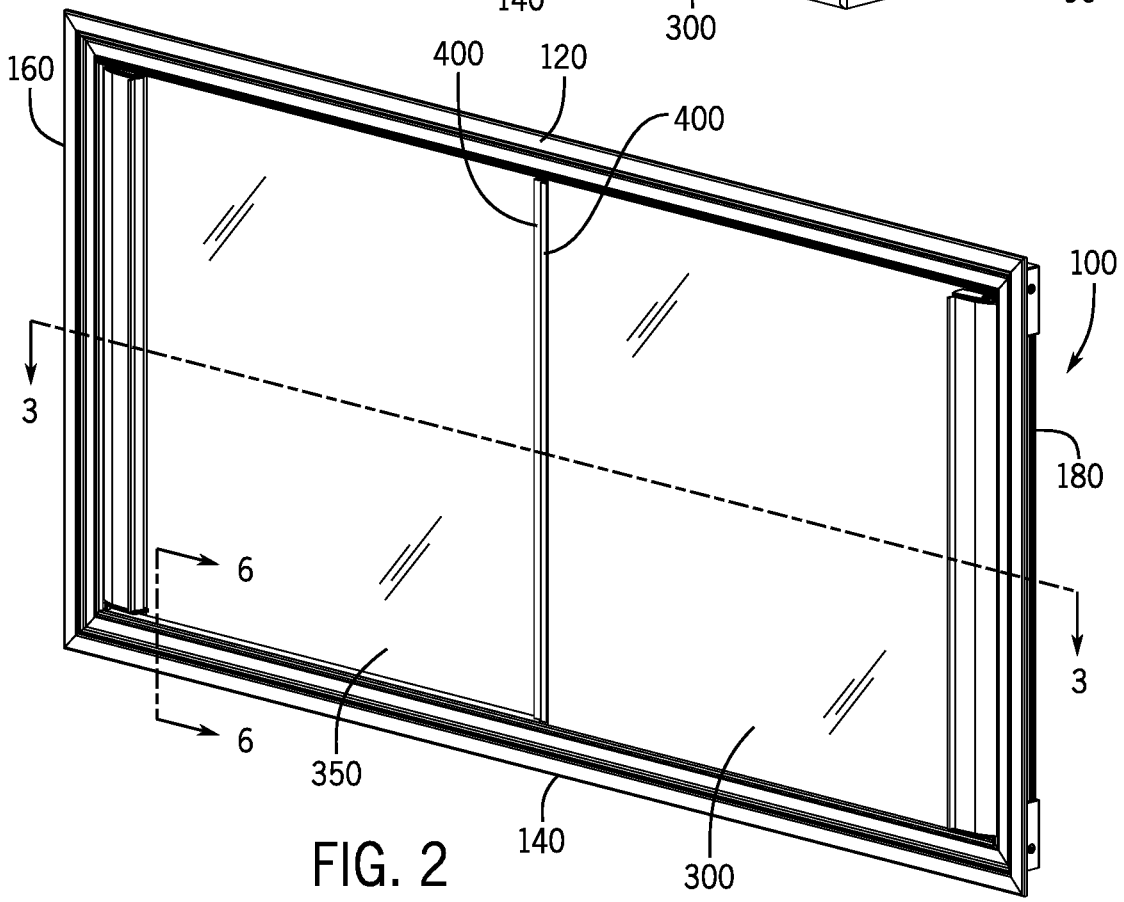
FIG. 2 is a perspective view of the frame.

With reference to FIGS. 1 and 2, a cabinet 10 and a frame 100 are shown. The frame 100 engages to a front of the cabinet 10. The frame 100 may be inserted over an opening of the cabinet 10.

The frame 100 includes an upper frame section 120 opposite of a lower frame section 140 and a left frame section 160 opposite of a right frame section 180.

The cabinet 10 may be formed to have a generally rectangular or square shape. The cabinet includes an upper wall 20 opposite of a lower wall 40 and a left side wall 60 opposite of a right side wall 80. The walls 20, 40, 60, and 80 generally define the opening for the cabinet 10. The walls 20, 40, 60, and 80 may be fastened together with or without a rear wall 90.

Figure 6:
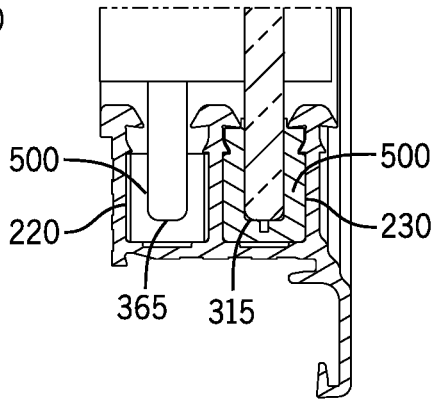
FIG. 6 is a sectional view of the frame holding the panel.
Figure 7A:
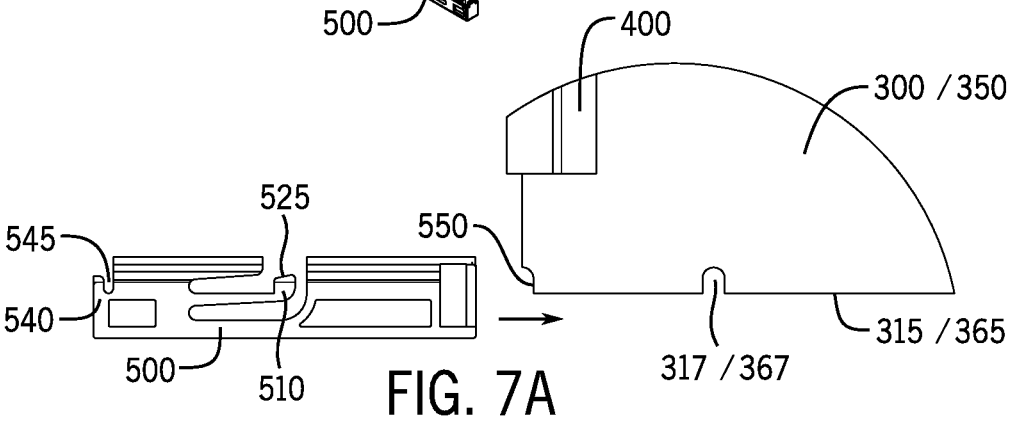
FIG. 7A is a view of the panel support before engagement to the panel.
Figure 7B:
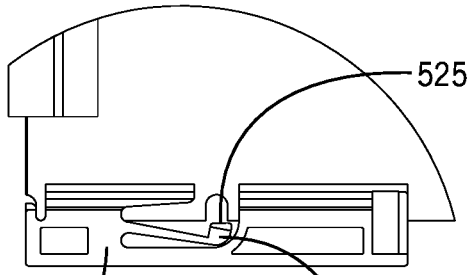
FIG. 7B is a view of the panel support with its spring depressed.
Figure 7C:
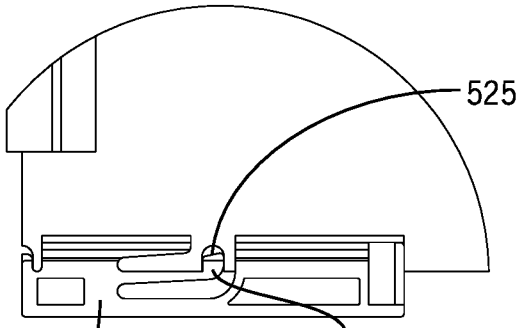
FIG. 7C is a view of the panel support engaged to the panel.
Figure 8:
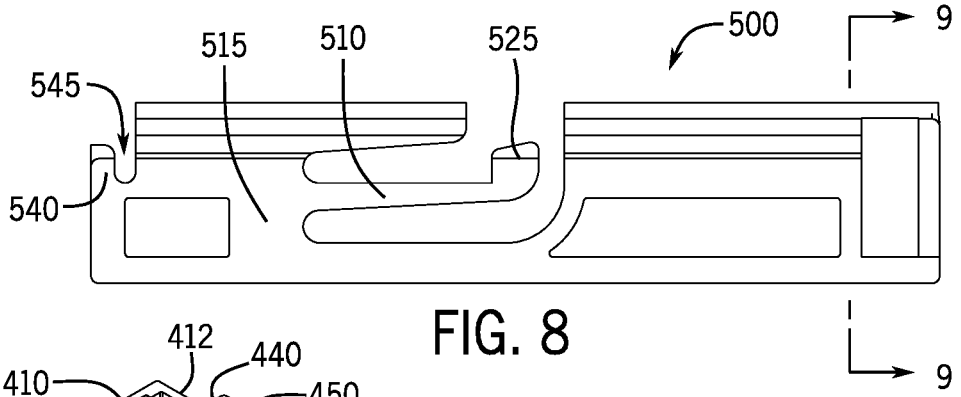
FIG. 8. is a front view of the panel support.
Figure 11:
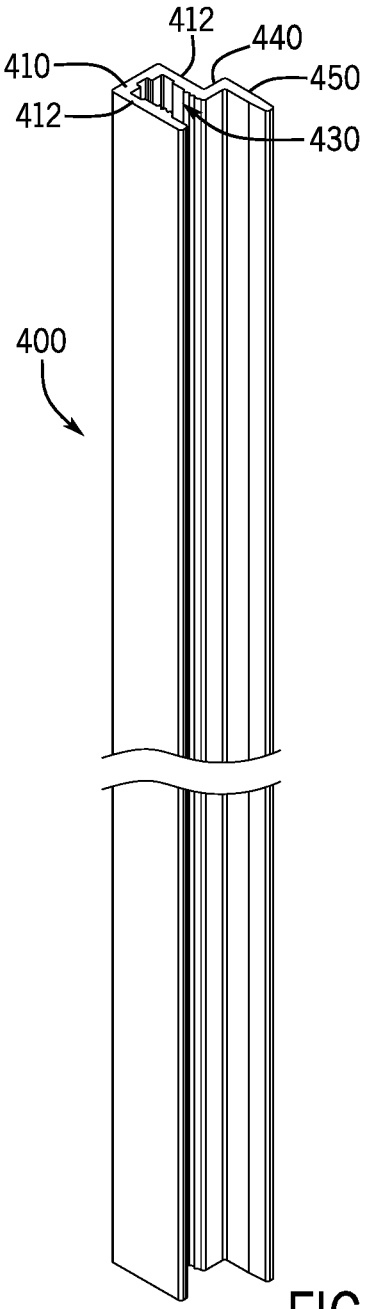
FIG. 11 is a perspective of the interlocking stiffener.
Figure 9:
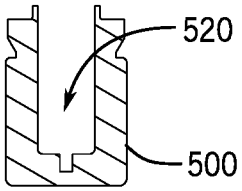
FIG. 9 is a sectional view of the panel support.

The lower frame section 140 and the upper frame section 120 of the frame may 100 hold a first panel 300 and a second panel 350 in a sliding engagement. With reference to FIG. 6, the first panel 300 and the second panel 350 are slidably mounted to the lower section 140 and the upper frame section 120. Both the lower section 140 and the frame section 140 include channels that receive the first panel 300 and the second panel 350 in the sliding engagement.

In this aspect, the first panel 300 forms an outer panel, and the second panel 350 forms an inner panel. Depending on the user preference, the first panel 300 may slide in front of the second panel 350 and/or the second panel 350 may slide behind the first panel 300. The panels 300 and 350 may formed from a variety of sheet-like materials, such as Plexiglass, polycarbonate, other plastics, metals, woods, composites, etc. The first panel 300 includes a forward leading edge 305, a rear leading edge 310, a bottom edge 315, and a top edge 320. The first panel 300 includes a front surface 325 and a rear surface 330. The forward leading edge 305 and the rear leading edge 310 may be generally perpendicular to the bottom edge 315 and the top edge 320. Similarly, the second panel 350 includes a forward leading edge 355, a rear leading edge 360, a bottom edge 365, and a top edge 370. The forward leading edge 355 and the rear leading edge 360 may be generally perpendicular to the bottom edge 365 and the top edge 370. The second panel 300 includes a front surface 375 and a rear surface 380. Although the frame 100 is shown with the two panels 300 and 350, the frame 100 may include additional panels. For example, the frame 100 may include three sliding panels.

An interlocking stiffener 400 is shown in FIGS. 3, 4, 11, and 12. The interlocking stiffener 400 includes a base portion 410 that forms a channel 430 to receive a leading edge of one of the panels 300 or 350. Sidewalls 412 define the channel 430. In the aspect show, two sidewalls 412 are on opposite sides of the channel 430. The interlocking stiffeners 400 may be positioned on the forward leading edges 305, 355, rear leading edges 310, 360, or both the forward and read leading edges 305, 355, 310, 360 of the panels 300 or 350. The interlocking stiffeners 400 shares forces across the adjacent panel 300 or 350 and stiffener 400. The interlocking stiffeners 400 on the adjacent panel 300 or 350 interlock with each other when the panels 300 and 350 are moved to a closed position.

The sidewalls 412 of the interlocking stiffeners 400 secure to the panel 300 or 350. The sidewalls 412 of the interlocking stiffeners 400 may be lined with teeth or other protrusions that bite into a surface of the panel 300 or 350. In alternative embodiments, the base portion 410 or sidewalls 412 may be affixed to the leading edge via screws, fasteners, epoxies, adhesives etc.

The interlocking stiffeners 400 include extending members 440 that extend sideways relative to a vertical height of the panels 300 or 350. The sidewall 412 transitions into the extending member 440, for example, the extending member 440 may be integral to the sidewall 412. The extending member 440 may extend generally perpendicular to the channel 430. The extending member 440 may include a support member 450 that extends in a generally perpendicular direction with respect to the extending member 440. As such, the support member 450 may be generally parallel to the extending member 440. The extending member 440 may transition into the support member 450, for example, the extending member 440 may be integral to the support member 450. Either one of the sidewalls 412 may include the extending member 440 and the support member 450. In other aspects, both of the sidewalls 412 include the extending member 440 and the support member 450.

Figure 3:
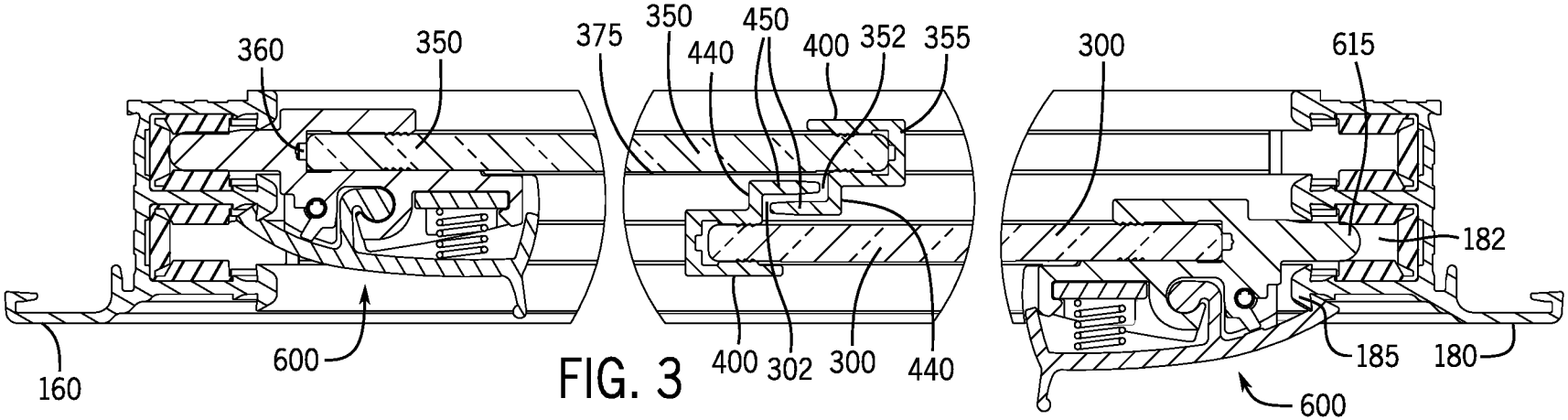
FIG. 3 is a sectional view of the frame.

The extending members 440 and/or the support members 450 may transfer forces to the adjacent panel 300 or 350 during, for example, a collision or other impact. When a force is applied to one of the panels 300 or 350, the panel 300 or 350 may bow slightly causing the extending member 440 and/or the support members 450 to contact the adjacent panel 300 or 350 and share or transfer the load or force. Similarly, when a force is applied to one of the panels 300 or 350, the panel 300 or 350 may bow slightly causing the surface of the panel 300 or 350 to contact the extending members 440 and/or the support members 450 of the adjacent panels 300. This provides a stronger design—with the panels 300 or 350 being able to withstand greater forces. FIG. 3 show two interlocking stiffeners 400 in a closed position where the support member 450 of the panel 300 is between the second panel 350 and the support member 450 of the panel 350, and the support member 450 of the panel 350 is between the first panel 300 and the support member 450 of the first panel 300. When a force is applied to the first panel 300, the support member 450 of the first panel 300 contacts the second panel 350 and the support member 450 of the second panel 350 contacts the first panel 300. In the closed position, the adjacent interlocking stiffeners 400 interlock with each other to increase the durability of the cabinet 10.

Figure 12:
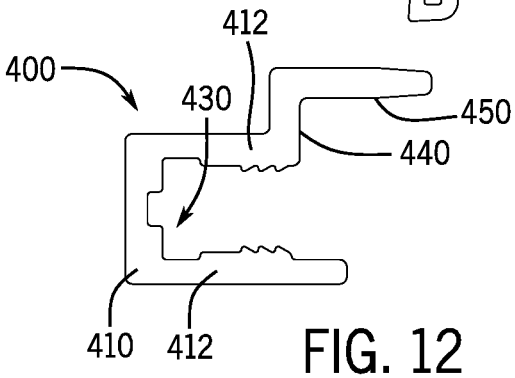
FIG. 12 is an end view of the interlocking stiffener.
Figure 13:
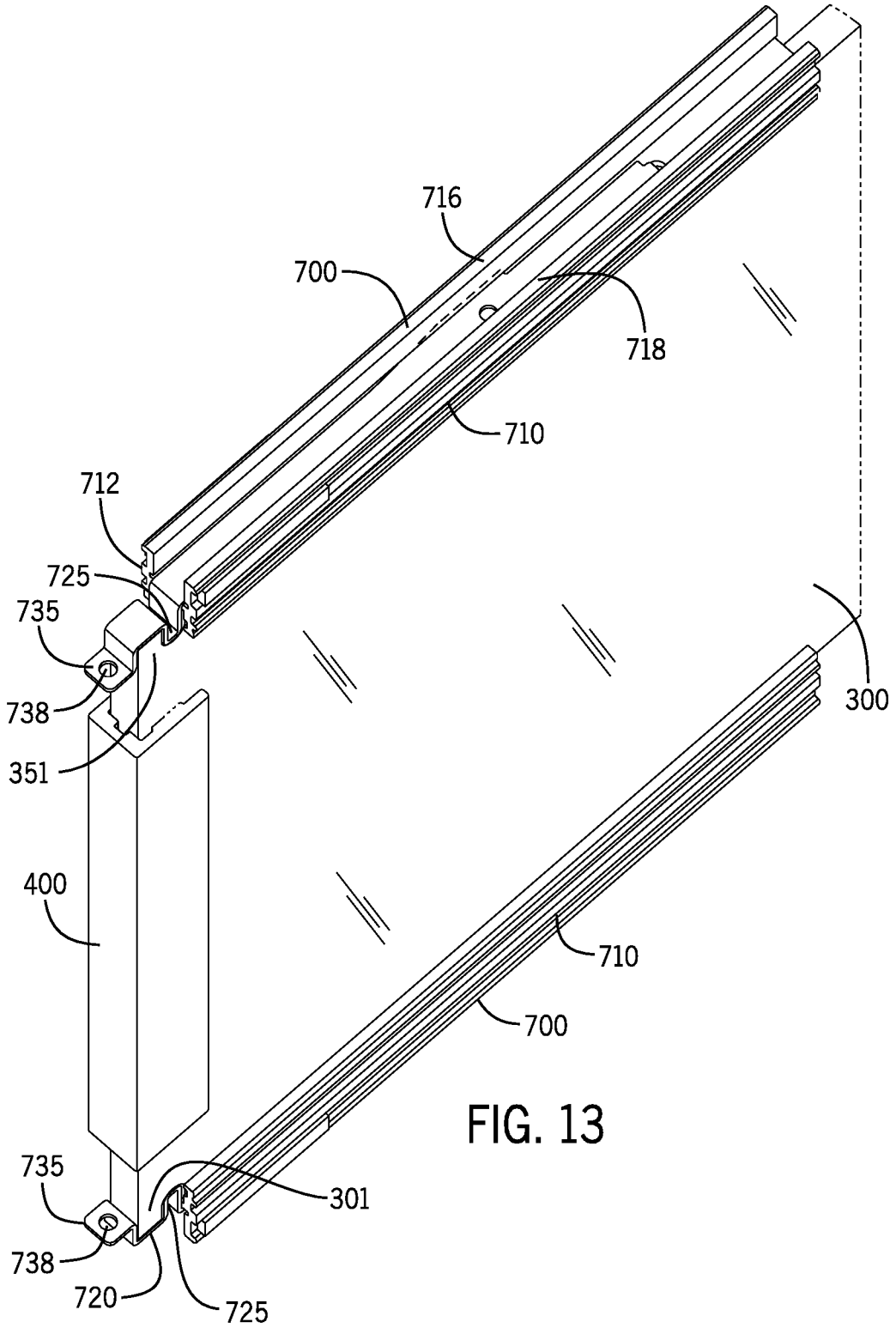
FIG. 13 is a perspective view of the panel with the panel supports.

The interlocking stiffeners 400 may be formed from an extruded metal, such as aluminum or other metal. For example, the aluminum may be melted and forced through a die resulting in lengths of an extrusion having an end view as shown in FIG. 12. The interlocking stiffeners 400 may be cut to length from the lengths of extrusion.

Figure 10:
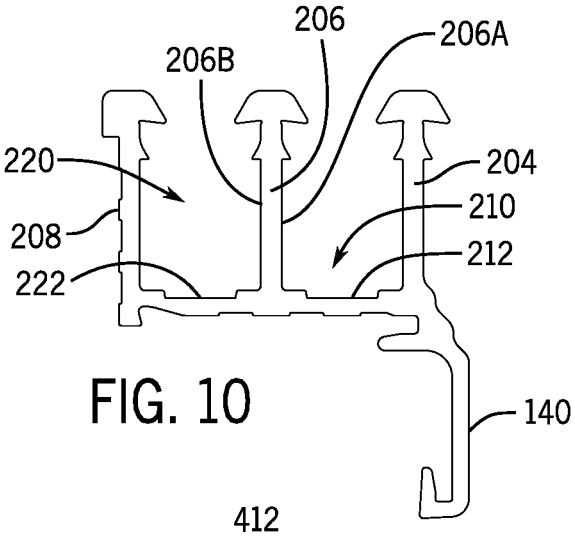
FIG. 10 is an end view of the frame.

With reference to FIGS. 6 and 10, the first panel 300 is slidably mounted in a first channel 210 of the lower frame section 140, and the second panel 350 is slidably mounted in a second channel 220 of the lower frame section 140. The upper frame section 120 includes corresponding channels to hold the top edges 320, 370. The upper frame section 120 may have a substantially similar or identical profile as the lower frame section 140. With reference to FIG. 10, an end view of the frame section 140 is shown. The frame section 140 includes a central wall 202. The frame section 140 includes an outer wall 204, a center wall 206, and an inner wall 208, which all extend generally perpendicular to the central wall 202. The frame section 140 and the other frame sections 120, 160, 180 may be formed using extruded metal alloys. For example, aluminum may be melted and forced through a die resulting in lengths of material having an end view as shown in FIG. 10.

The frame section 140 includes the first channel 210 with a first bottom surface 212. The frame section 140 includes the second channel 220 with a second bottom surface 222. The first channel 210 and the second channel 220 are in a parallel arrangement. The first channel 210 and the second channel 220 share the center wall 206 with a lateral side 206A of the center wall 206 forming one of the walls of the first channel 210 and another lateral side 206B of the center wall 206 forming one of the walls of the second channel 220. The upper frame section 120, the left frame section 160, and the right frame section 180 may be formed from the same lengths of extruded materials and thus have an identical cross-section to the lower frame section 140. The first channel 210 and the second channel 220 may extend a length of the frame section 140.

In the closed position, the adjacent interlocking stiffeners 400 interlock with each other to increase the durability of the cabinet 10. The panels 300 and 350 slide toward each other to interlock the stiffeners 400. As shown in FIG. 3, the panels 300 and 350 are in a closed position and the stiffener 400 on the panel 300 is locked with the stiffener 400 on the panel 350. The support member 450 of the panel 300 is in a space 352 formed between the support member 450 of the second panel 350 and the front surface 375 of the second panel 350. Likewise, the support member 450 of the second panel 350 is in a space 302 between the support member 450 of the first panel 300 and the rear surface 330 of the first panel 300. When an inward force is applied to the first panel 300, the support member 450 of the first panel 300 contacts the second panel 350 and the support member 450 of the second panel 350 contacts the first panel 300. When an outward force is applied to the second panel 350, the support member 450 of the second panel 350 contacts the first panel 300 and the support member 450 of the first panel 300 contacts the second panel 350.

With reference to FIGS. 7A-7C, 8 and 9, a panel support 500 is shown. The panel supports 500 support the panels 300, 350 in the lower frame section 140. The panel supports 500 may also be engaged to the top edges 320, 370 to assist in holding the top edges 320 and 370 in the upper frame section 120. The panel supports 500 removably attach or engage to the panels 300, 350. The panel supports 500 slide relative to the bottom surfaces 212, 222 of the channels 210, 220 of the frame 100 as the panels 300, 350 are moved in lateral directions. The panel supports 500 also act as a spacer to raise the panels 300, 350 from the lower frame section 140.

In the aspect shown, the panel support 500 includes a spring portion 510 extending upward from a body 515 of the panel support 500. The panel support 500 includes a central channel 520 that receives the bottom edge 315 of the first panel 300 or the bottom edge 365 of the second panel 350. The spring portion 510 includes a tab 525 that engages with a notch 317 in the bottom edge 315 of the panel 300 or a notch 367 in the bottom edge 365 of the second panel 350. In order to disengage the tab 525 from the notches 317 or 367, the user presses down on the spring portion 510 thus removing the tab 525 from the notches 317, 367 and releasing the bottom edges 315, 365 from the panel supports 500. The spring portion 510 biases upward through the channel 520. For removal of the panel supports 500 engaged to the top edges 320, 370, the spring portion 150 is pushed upwards.

The first panel 300 is mounted on top of two of the panel supports 500. Similarly, the second panel 350 is mounted on top of two of the panel supports 500. In other aspects, fewer or additional panel supports 500 may be employed. Additionally, panel supports 500 may be mounted to the top edges 320, 370. The lower panel supports 500 of the first panel 300 are positioned in the first channel 210 on the first bottom surface 212, while the panel supports 500 of the second panel 350 are positioned in the second channel 220 on the second bottom surface 222. The upper panel supports 500 are positioned in a first channel of the upper frame section 120, while the upper panel supports 500 of the second panel 350 are positioned in a second channel of the upper frame section 120.

The panel supports 500 slide relative to the bottom surfaces 212, 222 of the channels 210, 220 of the frame 100. The bottom surface 530 of the panel supports 500 glides or slides over the bottom surfaces 212 and 222 of the first channel 210 and the second channel 220. The panel supports 500 may be wholly or partially contained in the first channel 210 or the second channel 220.

The panel supports 500 allow the panels 300, 350 to be easily removed from the frame 100. The panel supports 500 include the spring portion 510 that removably engages to bottom edge 315, 365 of the sliding panels 300, 350. The panel supports 500 support the panels 300, 350. As such, the panel supports 500 elevate the bottom edges 315, 365 of the panels 300, 350 relative to the bottom surfaces 212 and 222 of the first channel 210 and the second channel 220. The panel supports 500 add sufficient height to cause the top edges 320, 370 of the panels 300, 350 to lodge in the channels of the upper frame section 120. Depending on the size of the panel 300, 350, one, two, or more panel supports 500 may engaged to the bottom edge 315, 365 of each panel 300, 350 and/or to the top edges 320, 370 of each panel 300, 350.

Once the panel supports 500 are disengaged from the bottom edges 315, 365 of the panels 300, 350, the panels 300, 350 may be moved laterally with respect to the panel supports 500 and then off of the panel supports 500. Or, the panel supports 500 may be disengaged from the bottom edges 315, 365 and then slid relative to the bottom edges 315, 365 until the panel supports 500 are no longer under the bottom edges 315, 365. Now, the panels 300, 350 may rest directly on the bottom surfaces 212, 222 of the channels 210, 220. With the reduced overall height resulting from the disengagement from the panel supports 500, the panels 300, 350 may be tilted forward and removed from the frame 100. This removability is especially useful when a panel 300, 350 has become scratched, damaged, etc. The panel support 500 may be molded from plastic materials with sufficient durability and biasing strength.

An end 540 of the panel support 500 may optionally include an opening 545 that receives a groove portion 550 of either the bottom edge 311 or 365. The insertion of the protruding portion 550 in the opening 545 assists in positioning the panel support 500 along the bottom edges 311 or 365.

Figure 4:
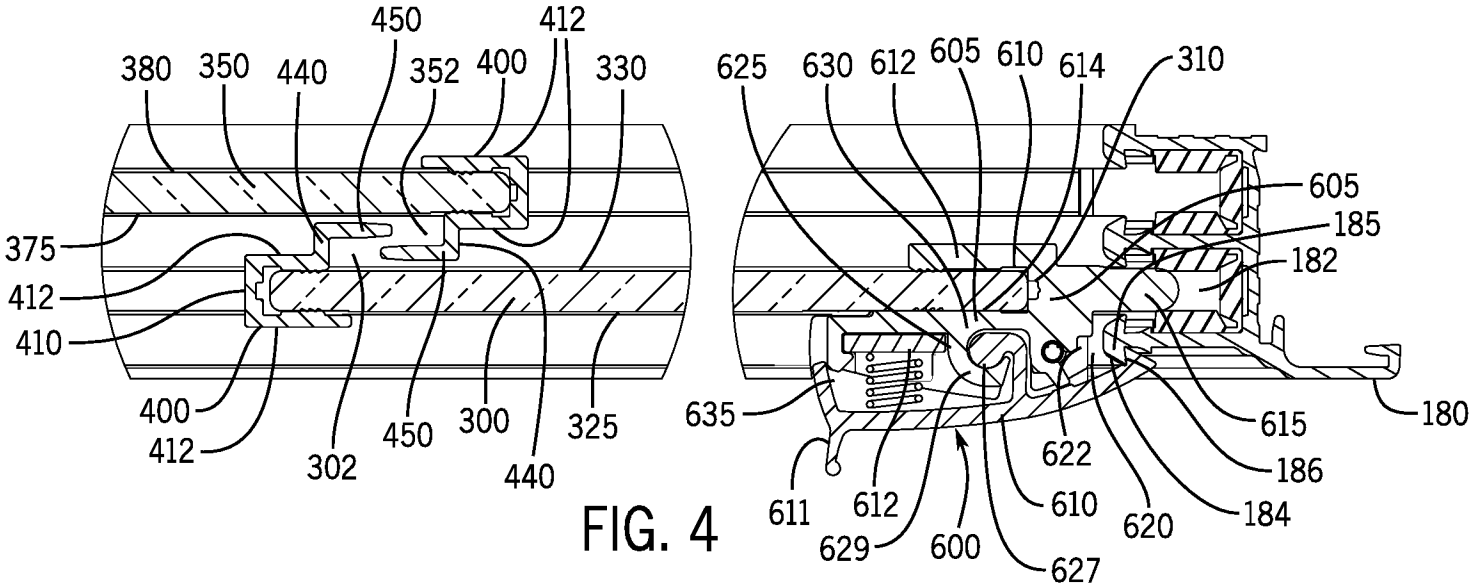
FIG. 4 is a sectional view of the frame.
Figure 5:
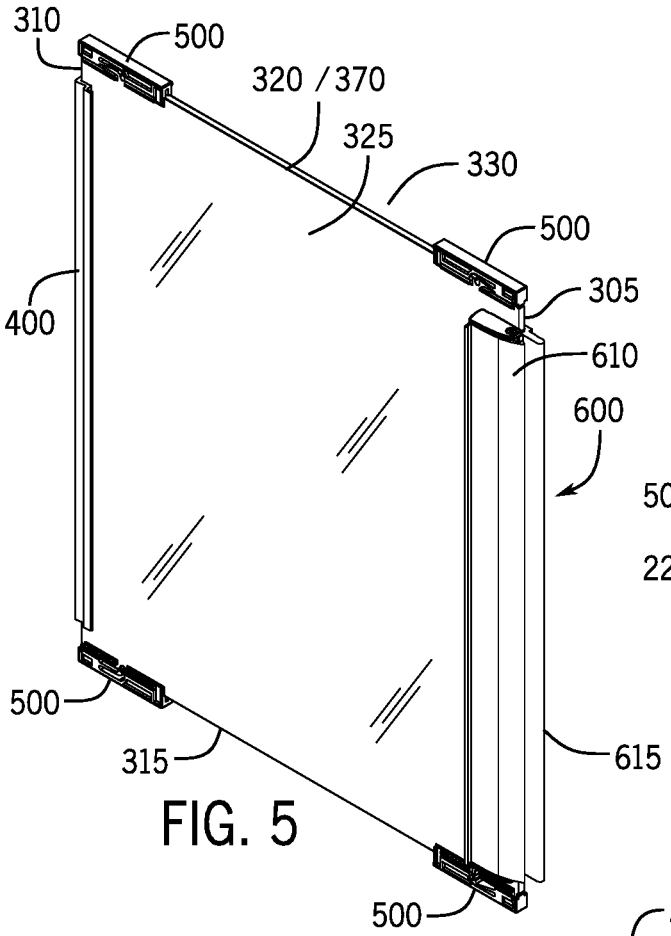
FIG. 5 is a perspective view of the panel.

With reference to FIGS. 3-5, in another aspect, a latch assembly 600 may be engaged to a forward edge or a rear edge of one or both of the panels 300, 350. Typically, each panel 300, 350 will include the latch assembly 600 on the end of the panel 300, 350 opposite of the end with the interlocking stiffeners 400. Of course, depending on the user's preference, only one panel 300, 350 may have the latch assembly 600.

The latch assembly 600 may cover most of the forward edge 305, 355 or rear edge 310, 360 of the panel 300, 350. The latch assembly 600 includes a central body 605 and a pawl member 610 pivotally engaged to the central body 605. The pawl member 610 engages with a striker 185 formed by the left or right frame sections 160, 180. The pawl member 610 and the striker 185 may include interacting locking surfaces with negative angles to provide further locking security. The striker 185 may be an integral feature of the left or right frame sections 160, 180. The striker 185 may be formed during the extrusion process that forms the left or right frame sections 160, 180.

The central body 605 defines a channel 610 to receive the forward edge 310 of the first panel 300. The channel 610 is formed by space between an inner wall 612 of the central body 605 and an outer wall 614 of the central body 605. The channel 610 may be lined with teeth or other protrusions that bite into a surface of the forward edge 310 of the first panel 300. In alternative embodiments, the central body 605 may be affixed to the forward edge 310 via screws, fasteners, epoxies, adhesives etc.

The central body 605 includes a protruding member 615 opposite of the channel 610. The protruding member 615 assists in positioning the latch assembly 600 for proper closure. During a closing operation, the protruding member 615 enters a channel 182 of the right frame section 180. This positions a sloped end 620 of the pawl member 610 at a complementary sloped end 184 of the striker 185 of the right frame section 180. The sloped end 620 moves against the sloped end 184 until a hook portion 622 of the pawl member 610 hooks with an opposing side 186 of the striker 185. The opposing side 186 is opposite of the sloped end 184.

The protruding member 615 assists in properly aligning the pawl member 610 with the striker 185 of the right frame section 180. The protruding member 615 may include one or more ridges or raised surfaces to further aid in alignment. The protruding member 615 may be in the form of a "bull nose" shape, i.e., the protruding member 615 may have a tapered or rounded leading surface to enter into the channel 182 of the right frame section 180.

The pawl member 610 is pivotally engaged to the central body 605 by an axis portion 625 of the pawl member 610 that rotates in an opening 630 of the central body 605. A lever portion 627 connects the axis portion 625 with the remainder of the pawl member 610. The lever portion 627 passes through an opening 629 of the central body 605. The interaction between the lever portion 627 and the opening 629 of the central body 605 limits the range of movement of the pawl member 610. The pawl member 610 further includes a handle portion 611.

The pawl member 610 is normally biased to a closed position by a spring member 635 biased between the central body 605 and an interior surface 640 of the pawl member 610. After the hook portion 622 of the pawl member 610 hooks with the opposing side 186 of the sloped end 184, the biasing force from the spring member 635 helps to maintain the engagement of the hook portion 622 to the opposing side 186.

In the aspect shown, the axis portion 625 is between the handle portion 611 and the hook portion 622. The axis portion 625 rotates in the opening 630 of the central body 605. The opening 630 may be adjacent to the outer wall 614 of the central body 605.

Although the latch assembly 600 is described above with reference to the right frame section 180, the latch assembly 60 may also engage the left frame section 160. The latch assembly 600 may include a striker and pawl assembly having a negative angle that resists opening forces. In the aspect show, there is an approximately 7 degree negative angle between the hook portion 622 and the opposing side 186 of the striker 185. The negative angle strengthens the closing ability of the latch assembly 600. The latch assembly 600 includes the hook portion 622 of the pawl member 610 with a first negative angle forming a first locking surface and the striker 185 includes the opposing side 186 with a second negative angle forming a second locking surface.

With reference to FIGS. 13-27, a panel support 700 is shown. The panel supports 700 support the panels 300, 350 in the lower frame section 140 and/or in the upper frame section 120. The panel supports 700 may engage to the bottom edges 315, 365 of the panels 300, 350 to assist in holding the bottom edges 315, 365 in the lower frame section 140. The panel supports 700 may also engage to the top edges 320, 370 of the panels 300, 350 to assist in holding the top edges 320 and 370 in the upper frame section 120. The panel supports 700 may be rotated 180 degrees to either fit to the top edges 320, 370 or to fit the bottom edges 315, 365.

In the aspect shown, the panel support 700 includes a holding member 720. The holding member 720 may be attached or integrated to the panel support 700. During normal operation, the holding member 720 is not removed or separated from the panel support 700.

The holding member 720 lockingly engages to the panels 300, 350 to hold the panels 300, 350 to the panel support 700. The panel supports 700 slide relative to the bottom surfaces 212, 222 of the channels 210, 220 of the lower frame section 140 as the panels 300, 350 are moved in lateral directions. The panel supports 700 also act as a spacer to raise the panels 300, 350 from the lower frame section 140. When it is desired by the user to remove or replace any of the panels 300, 350, the holding member 720 may be unlocked from the panels 300, 350, such that the panels 300, 350 may be separated from the panel supports 700.

Figure 14:
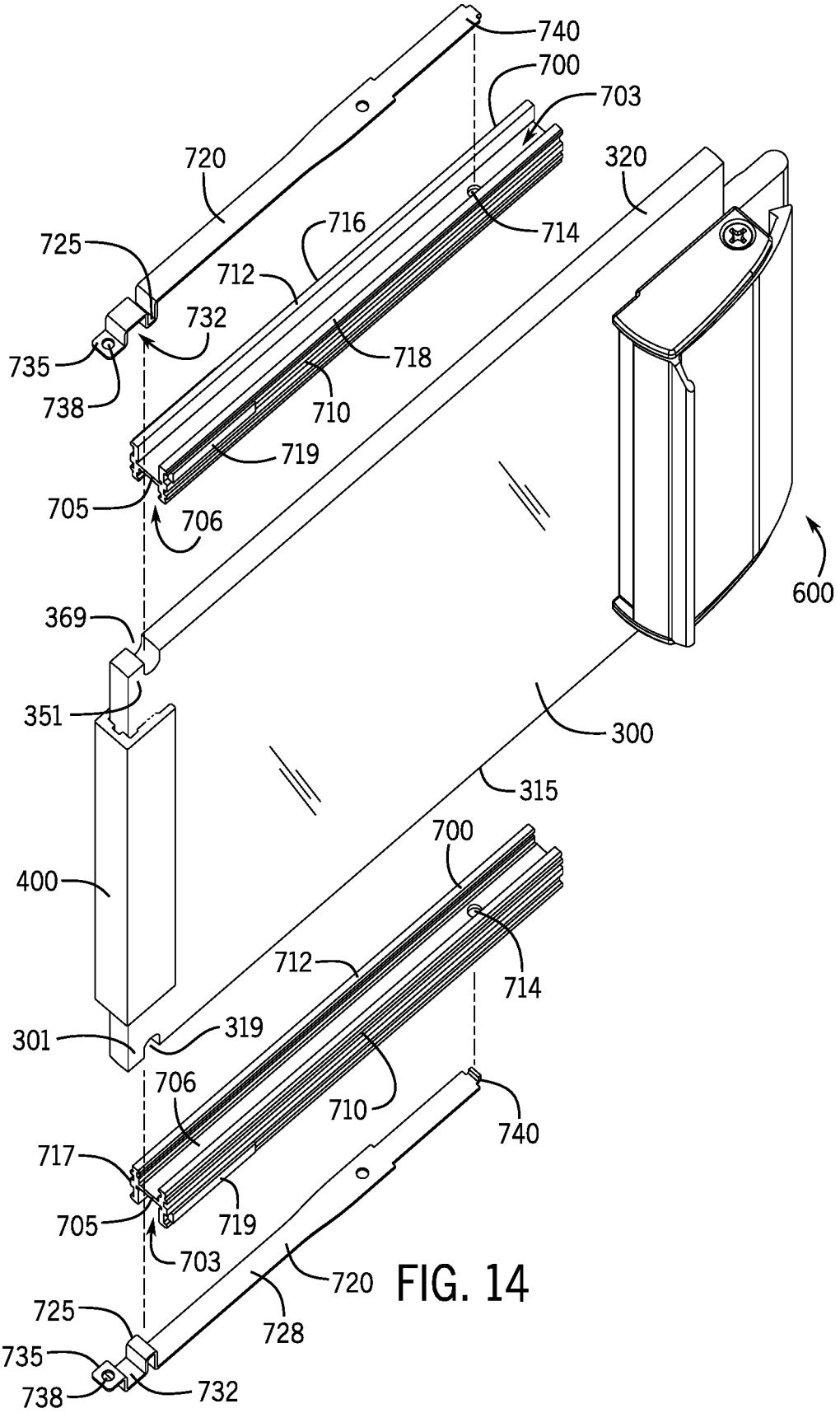
FIG. 14 is an exploded view of the panel with the panel supports.
Figure 15:
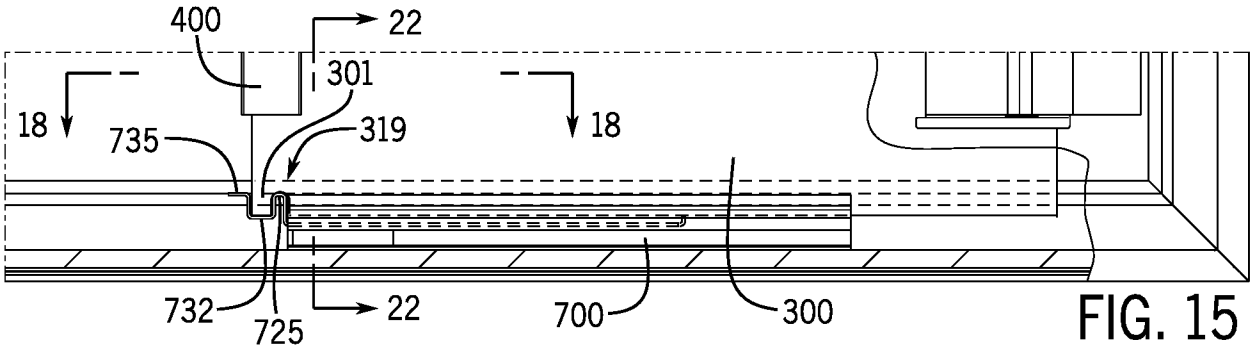
FIG. 15 is a view of the panel support engaged to the panel.
Figure 16:
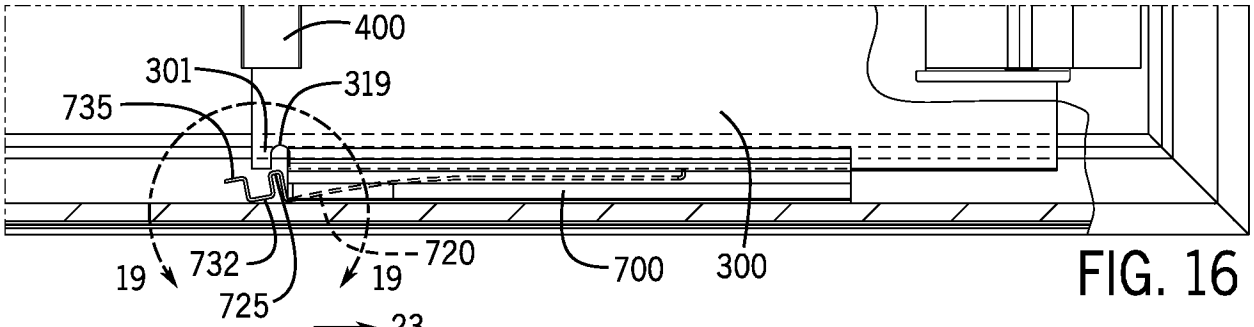
FIG. 16 is a view of the panel support with its end portion depressed.
Figure 17:
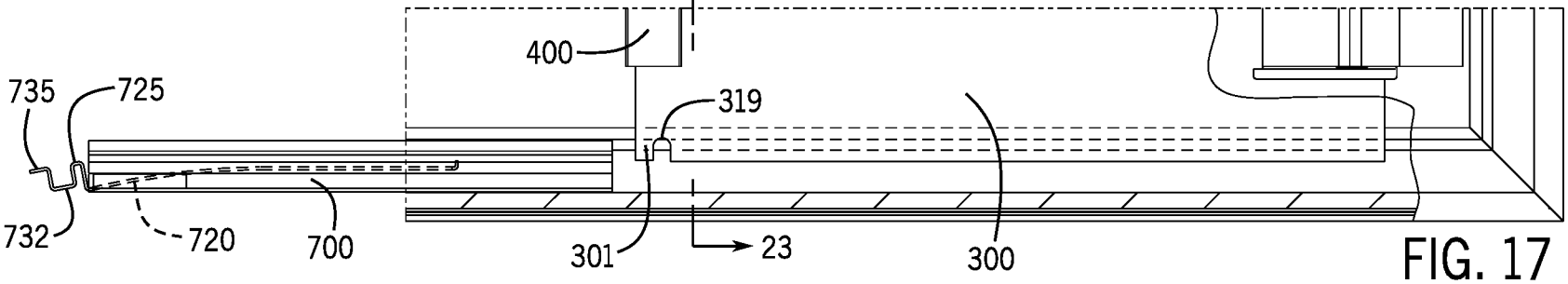
FIG. 17 is a view of the panel support removed from the panel.
Figure 18:
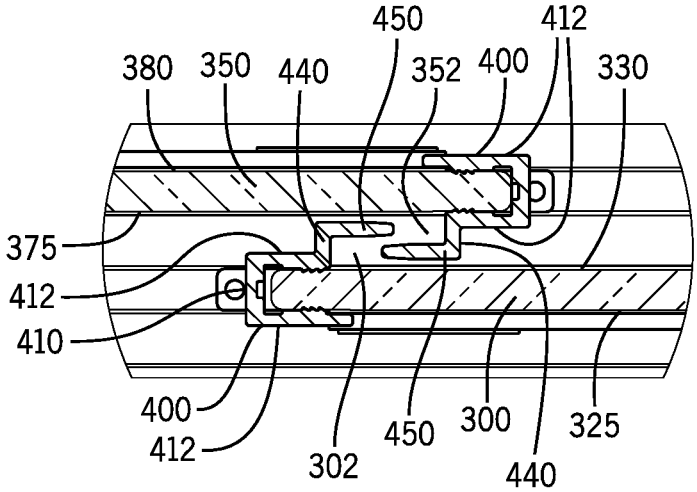
FIG. 18 is a top down sectional view of the panels.

With reference to FIG. 14, the panel support 700 includes a first central channel 703 that receives the bottom edge 315 of the first panel 300. The panel support 700 includes a second central channel 706 that receives most of a length of the holding member 720. In FIG. 14, another panel support 700 includes the first central channel 703 that receives the top edge 320 of the first panel 300.

The panel support 700 includes a center wall 705 that separates the first central channel 703 from the second central channel 706. The first central channel 703 and the second central channel 706 generally extend a length of the panel support 700. The first central channel 703 and the second central channel 706 are on opposite sides of the center wall 705 in a generally parallel alignment. The central wall 705 includes an opening 714 to engage with the holding member 720. The panel support 700 includes a first sidewall 710 and a second sidewall 712 that are generally perpendicular to the center wall 705. The sidewalls 710 and 712 form lateral boundaries for the first central channel 703 and the second central channel 706. The sidewalls 710 and 712 may define the first central channel 703 and the second central channel 706. Edges 716 and 718 of the sidewalls 710 and 712 slide relative to the bottom surfaces 212, 222 of the channels 210, 220 of the lower frame section 140 as the panels 300, 350 are moved in lateral directions. Exterior portions of the sidewalls 710 and 712 may include felt pads 719 to provide a damping action to the sliding of the sliding panels 300 and 250.

Figure 20:
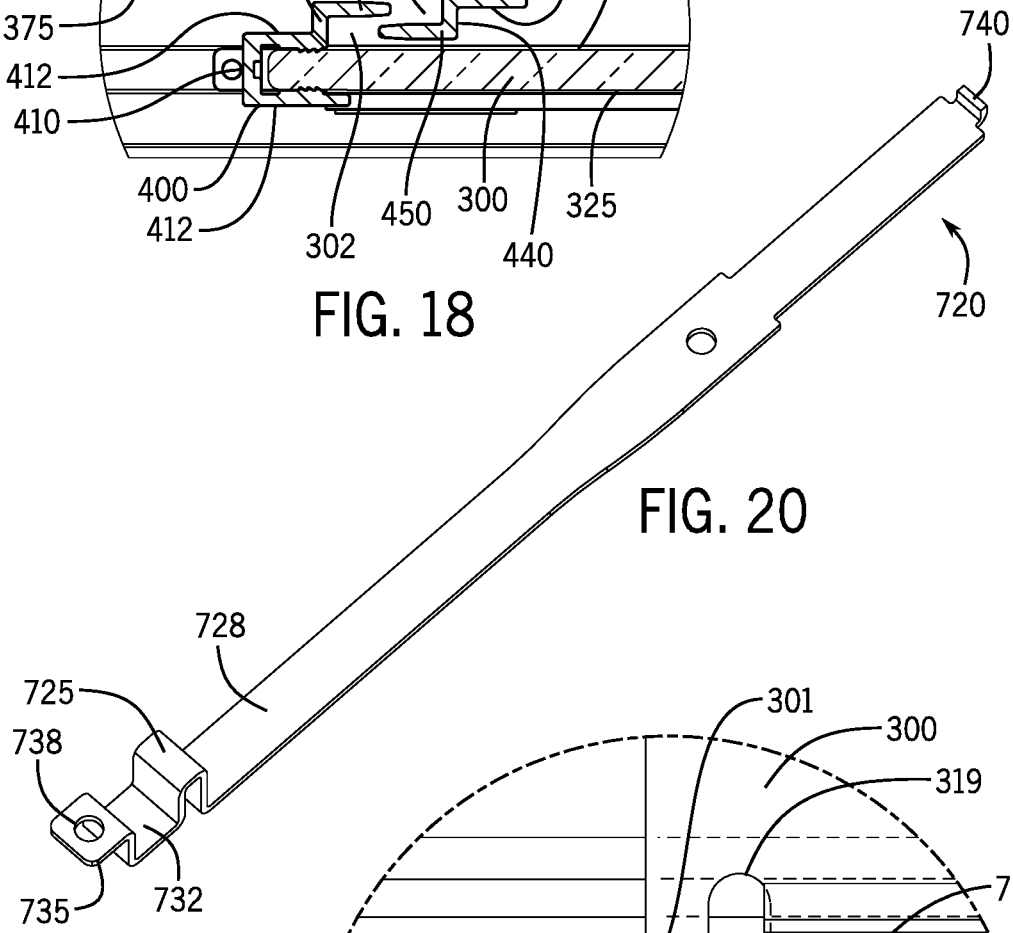
FIG. 20 is a perspective view of the holding member.
Figure 19:
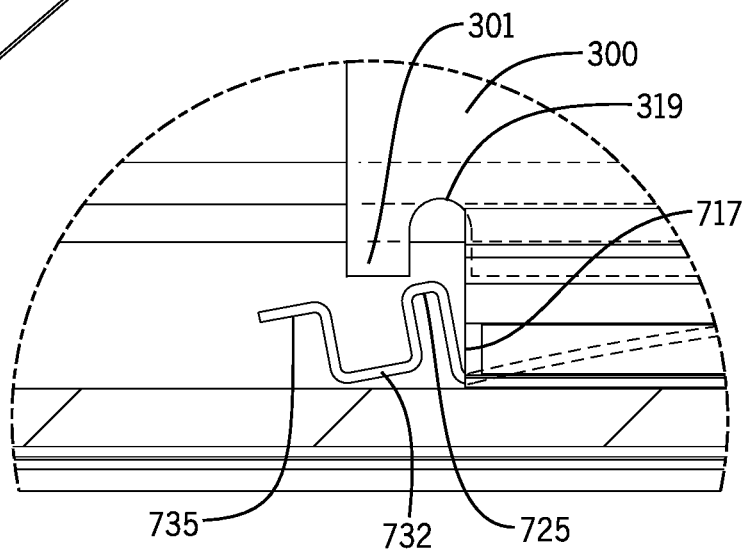
FIG. 19 is a close-up view of the panel support with its end portion depressed.
Figure 21:
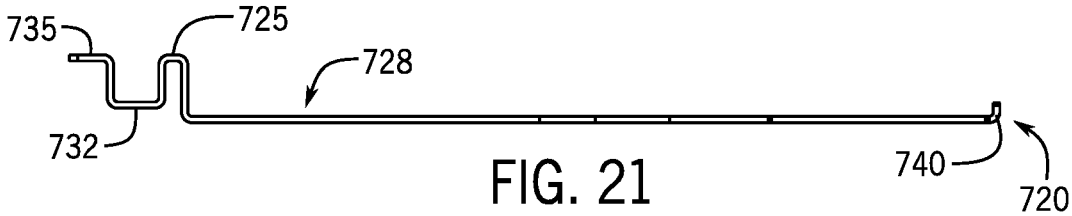
FIG. 21 is a side view of the holding member.
Figure 22:
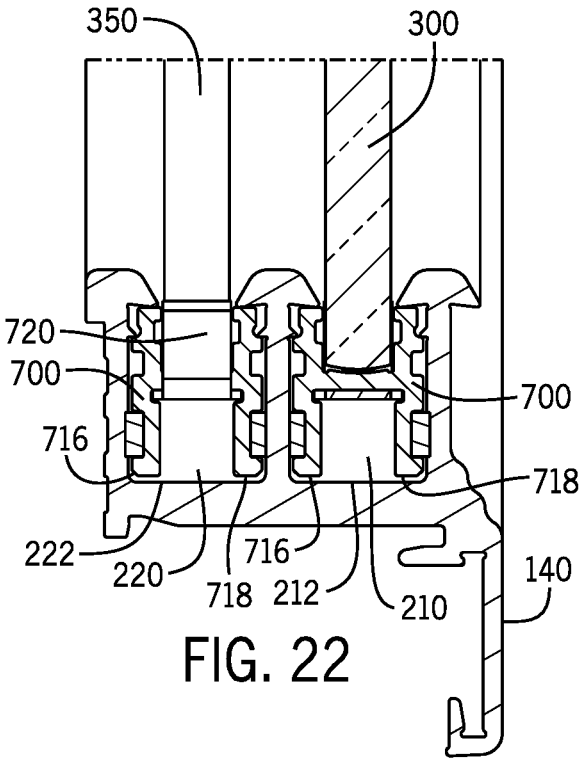
FIG. 22 is an end sectional view of the panels.
Figure 23:
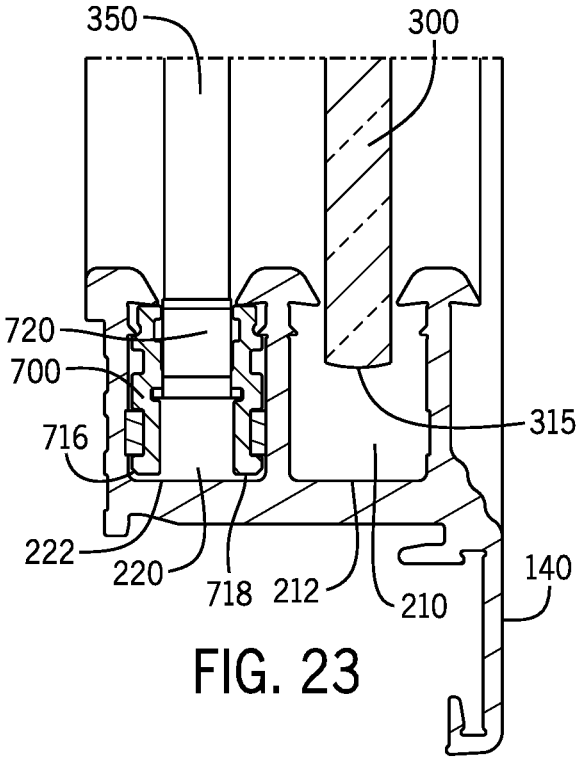
FIG. 23 is an end sectional view of the panels with the panel support removed.
Figure 24:
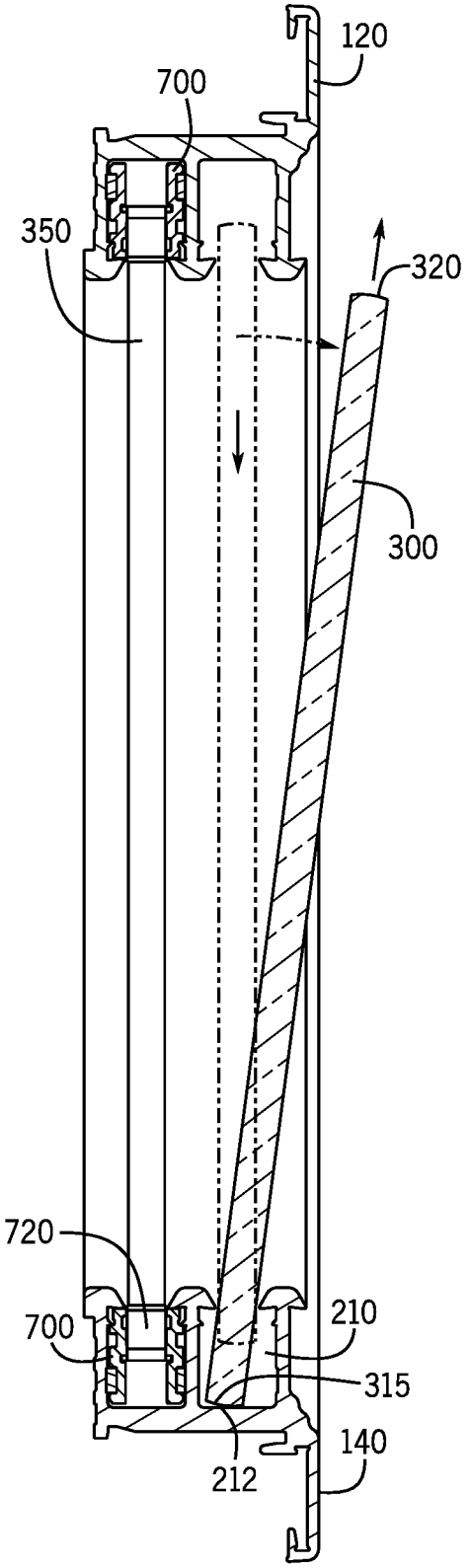
FIG. 24 is an end sectional view of the panels with the panel support removed and one of the panels lowered for removal.

With reference to FIGS. 20 and 21, perspective and side views of the holding member 720 are shown. The holding member 720 includes a tab 725 that engages with a notch 319 in the bottom edge 315 of the panel 300. When the panel support 700 is engaged to the panels 300, 350, the holding member 720 biases the tab 725 into the notch 319. The notch 319 is formed proximate to a corner 301 of the panel 300. The tab 725 may be formed from an integral bend in the holding member 720. The tab 725 is generally perpendicular to a length of the holding member 720. The tab 725 is positioned adjacent a first lateral end 717 of the panel support 700. The tab 725 may extend from a contact surface 728 of the holding member 720. When the holding member 720 is installed to the panel support, the tab 725 may extend into a plane formed by the first central channel 703. The contact surface 728 of the holding member 720 is against or proximate the second central channel 706 of the panel support 700 when the holding member 720 is installed to the panel support 700. The tab 725 transitions into a concave portion 732 that receives the corner 301, 351 of the panels 300, 350. The concave portion 732 transitions into an end portion 735. Opposite of the end portion 735, the holding member 720 includes a catch 740, which engages to the opening 714 in the panel support 700. The catch 740 may include a hook or other engaging member that extends from the holding member 720.

In this aspect, the holding member 720 is attached to the panel support 700 by the catch 740 engaging to the opening 714 in the panel support 700 and by the bias of the tab 725 against the first lateral end 717 of the panel support 700. In other aspects, the holding member 720 may be integrally molded or mechanically integrated to the panel support 700. In other aspects, other springs and/or other biasing members may be used instead of the holding member 720 to engage with the panels 300, 350. Such springs or biasing members may be attached, integrally molded, or mechanically integrated to the panel support 700. Such springs or biasing members would extend a tab or other locking feature or member from the panel support 700 to lockingly engage with the panels 300, 350.

The end portion 735 includes a horizontal surface for the user to press against in order to release the panel support 700 from the panel 300 or 350. The end portion 735 may include a threaded opening 738. As described below in greater detail, a screw 745 may threadably engage to the threaded opening 738. When the user presses against the end portion 735, the holding member 720 may flex or bend (against its inherent bias).

The engagement of the panel 300 to the panel support 700 will now be described. The bottom edge 315 of the panel 300 is inserted into the first central channel 703 of the panel support 700 and against the holding member 720. The tab 725 of the holding member 720 inserts into the notch 319 in the bottom edge 315 of the panel 300. The concave portion 732 of the holding member 720 receive the corner 301 of the panel 300. The panel 300 is now engaged to the panel support 700.

The disengagement of the panel 300 to the panel support will now be described. As noted above, the holding member 720 includes the tab 725 that inserts into the notch 319 in the bottom edge 315 of the panel 300. In order to disengage the tab 725 from the notch 319, the user presses down on the end portion 735 of the holding member 720, thus flexing the holding member 720 and removing the tab 725 from the notch 319 and releasing the bottom edges 315, 365 from the panel supports 700. For removal of the panel support 700 engaged to the top edge 320, the end portion 735 of the holding member 720 is pushed upwards to remove the tab 725 from a notch 369.

In the aspect shown, the first panel 300 is mounted on one panel support 700. Similarly, the second panel 350 is mounted on one panel support 700. In other aspects, additional panel supports 700 may be employed. Additionally, panel supports 700 may be mounted to the top edges 320, 370.

The lower panel support 700 of the first panel 300 is positioned in the first channel 210 on the first bottom surface 212, while the panel support 700 of the second panel 350 is positioned in the second channel 220 on the second bottom surface 222. The upper panel support 700 is positioned in a first channel of the upper frame section 120, while the upper panel support 700 of the second panel 350 is positioned in a second channel of the upper frame section 120.

The panel supports 700 slide relative to the bottom surfaces 212, 222 of the channels 210, 220 of the frame 100. The bottom surface 730 of the panel supports 700 glides or slides over the bottom surfaces 212 and 222 of the first channel 210 and the second channel 220. The panel supports 700 may be wholly or partially contained in the first channel 210 or the second channel 220.

The panel supports 700 allow the panels 300, 350 to be easily removed from the frame 100. The panel supports 700 include the holding member 720 that engages to bottom edge 315, 365 of the sliding panels 300, 350. The panel supports 700 support the panels 300, 350. As such, the panel supports 700 elevate the bottom edges 315, 365 of the panels 300, 350 relative to the bottom surfaces 212 and 222 of the first channel 210 and the second channel 220. The panel supports 700 add sufficient height to cause the top edges 320, 370 of the panels 300, 350 to lodge in the channels 215, 225 of the upper frame section 120.

Once the panel supports 700 are disengaged from the bottom edges 315, 365 of the panels 300, 350, the panels 300, 350 may be moved laterally with respect to the panel supports 700 and then off of the panel supports 700. Or, the panel supports 700 may be disengaged from the bottom edges 315, 365 and then slid relative to the bottom edges 315, 365 until the panel supports 700 are no longer under the bottom edges 315, 365. Now, the panels 300, 350 may rest directly on the bottom surfaces 212, 222 of the channels 210, 220. With the reduced overall height resulting from the disengagement from the panel supports 700, the panels 300, 350 may be tilted forward or aft and removed from the frame 100. This removability is especially useful when a panel 300, 350 has become scratched, damaged, etc. The panel support 700 may be molded from plastic materials with sufficient durability and biasing strength.

Figure 25:
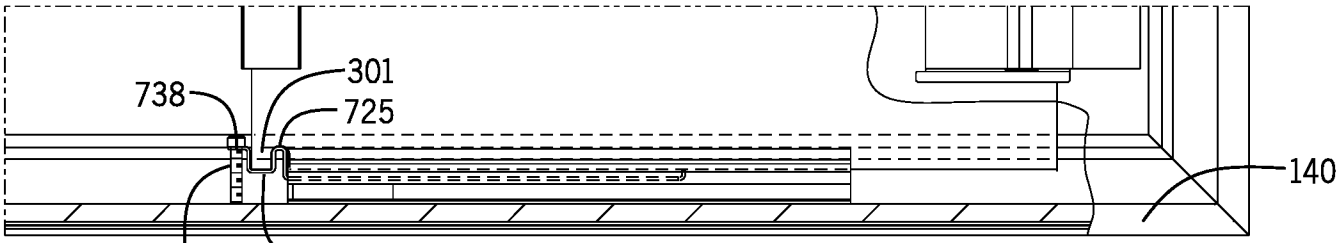
FIG. 25 is a side view of the panel with the screw preventing the end portion from being depressed.
Figure 26:
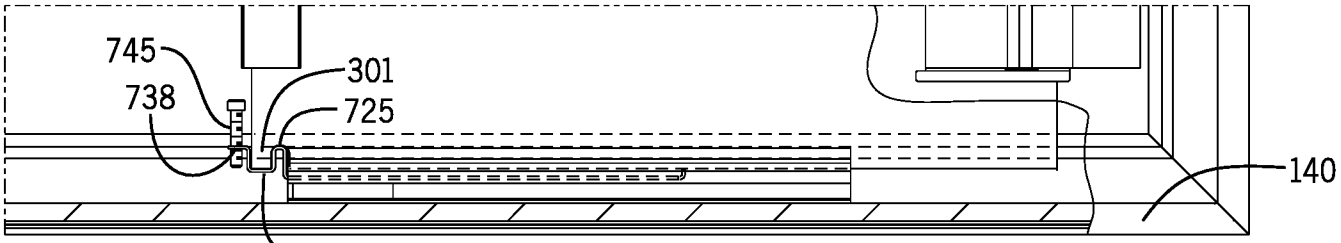
FIG. 26 is a side view of the panel with the screw raised and no longer preventing the end portion from being depressed.
Figure 27:
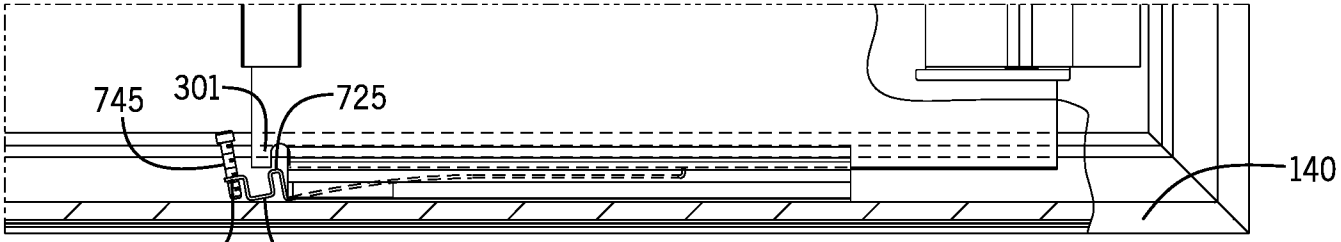
FIG. 27 is a side view of the panel with the end portion being depressed.

With reference to FIGS. 25-27, the panel support 700 is shown with the screw 745 that threadably engages to the threaded opening 738 in the end portion 735. When the screw 745 is fully screwed down, the end portion 735 cannot be depressed, as an end of the screw will contact the bottom surfaces 212, 222 of the channels 210, 220. This prevents the holding member 720 from flexing. Thus, the screw 745 has to be unscrewed for the user to be able to depress the end portion 735 in order to separate the panel support 700 from the panel 300. The use of the screw 745 provides extra security to maintain the panel 300, 350 in proper position.

The panel support 700 may be used with frame assemblies and openings that employ one panel or multiple panels. The panel support 700 may be used in a variety of applications that employ a sliding panel or cover that moves relative to a frame, cabinet opening, closet opening, door opening, etc.

Figure 28:
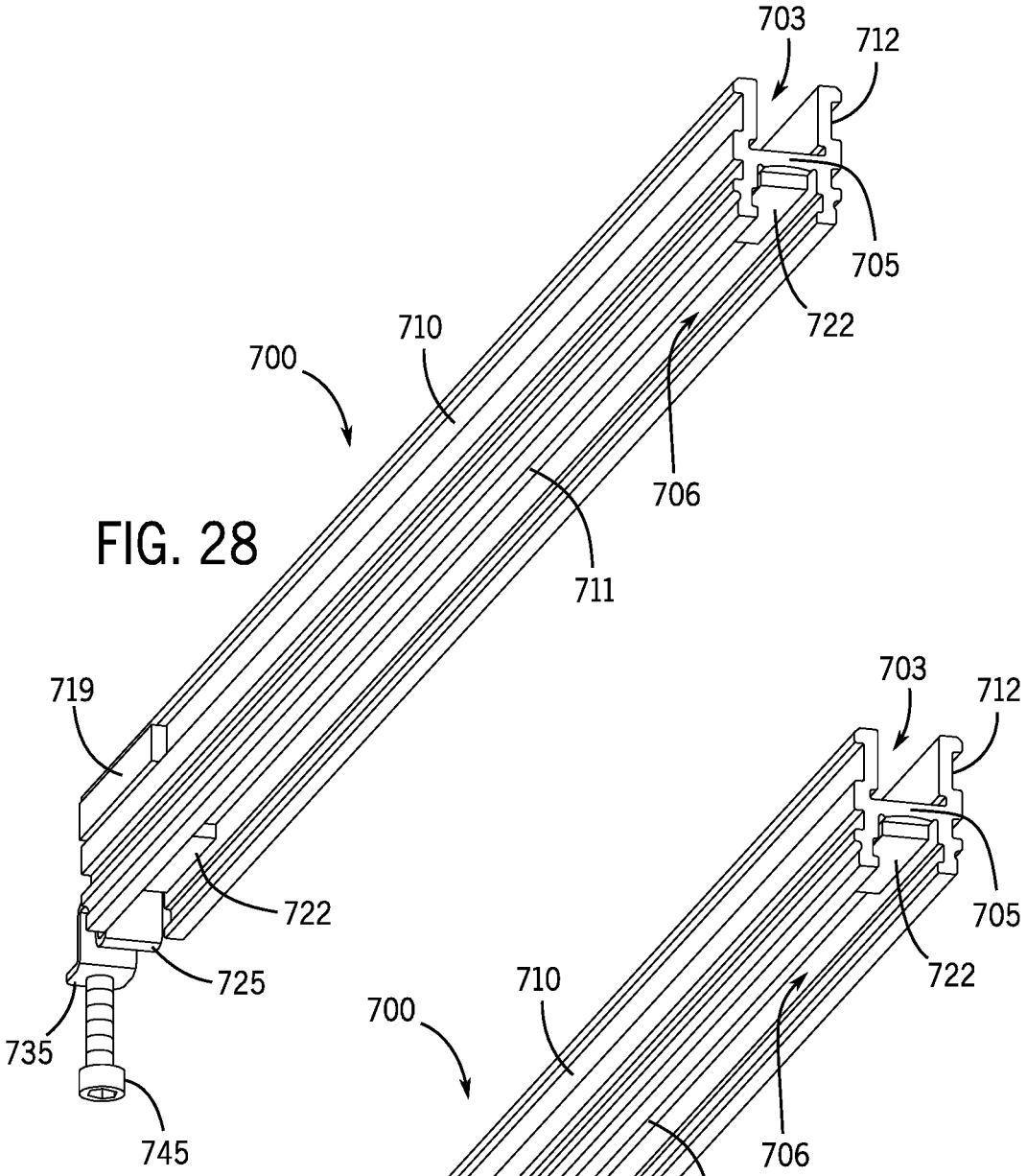
FIG. 28 is bottom perspective view of the panel support showing the positioning elements.
Figure 29:
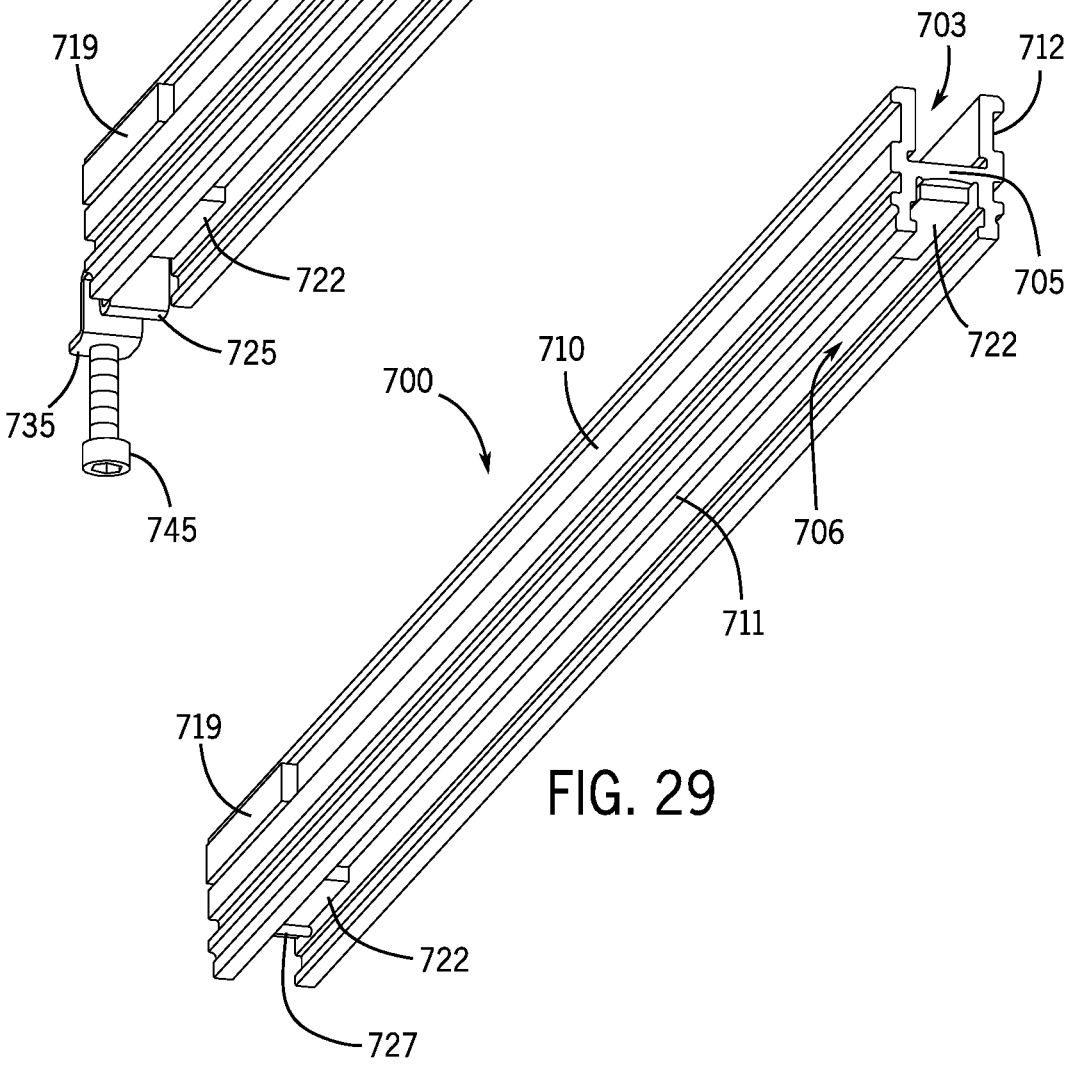
FIG. 29 is bottom perspective view of the panel support showing the fastener.

With respect to FIG. 28, positioning elements 722 are included in an interior of the second central channel 706 of the panel support 700 that is used in the upper or the top position on the panel 300, 350. The positioning elements 722 assist in accommodating tolerance variations in the size of the panels, 300, 350 and the frame sections 120 and 140. If the panel 300, 350 is a little too short for the respective frame sections 120 or 140, then the panel 300, 350 may exhibit unwanted movement. The positioning elements 722 provide a downward force to the top edge 320, 370 of the panel 300, 350 to prevent or reduce the unwanted movement.

The positioning elements 722 may be located against a bottom surface 711 of the center wall 206. In the aspect shown, two positioning elements 722 are positioned on opposite ends of the panel support 700. The positioning elements 722 may include foam, springs, biasing members, spring steel tabs, or other flexibly resilient materials. In the aspect shown, the two positioning elements 722 are foam blocks inserted into the second central channel 706 and positioned against the bottom surface 711 of the center wall 206.

In other aspects, the holding member 720 may be used with the panel supports 700 holding the bottom edges 315, 365 of the panels 300, 350, while the panel supports 700 holding the top edges 320, 370 of the panels 300, 350, may omit the holding member 720 and include a fastener 727, such a pin or rod, that extends across the second central channel 706 at the first lateral end 717 of the panel support 700, i.e., the fastener 727 may extend across the interior of the second central channel 706 between the sidewalls 710 and 712. The notch 369 in the top edge 320 of the panel 300 receives the fastener 727 when the top edge 320 is inserted into the panel support 700. The fastener 727 engaging to the notch 369 holds the panel support 700 to the top edge 320 of the panel 300.

With reference to FIGS. 30-37, the panel 300 is shown being removed from the frame 100 by first disengaging the panel support 700 in the upper frame section 120 and then lifting the panel 300 from the panel support 700 in the lower frame section 140. By disengaging the panel support 700 in the upper frame section 120 first, a weight of the panel 300 is supported by the panel support 700 in the lower frame section 140, which may provide an easier removal process for the user. By removing the panel support 700 from the top edge 320 first, the user does not need to hold up the panel 300 while removing the panel support 700 from the bottom edge 315, as the panel 300 may be lifted and tilted out from the frame 100. This removal sequence is described in greater detail below. In FIGS. 30-37, the panels 300 and 350 are held by the panel supports 700 in channels 215 and 235, respectively, of the upper frame section 120 and further by the panel supports 700 in channels 210 and 220, respectively, of the lower frame section 140. Of course, the user may still remove the panels 300, 350 by first removing the panel support 700 in the lower frame section 140, as described herein.

Figure 30:
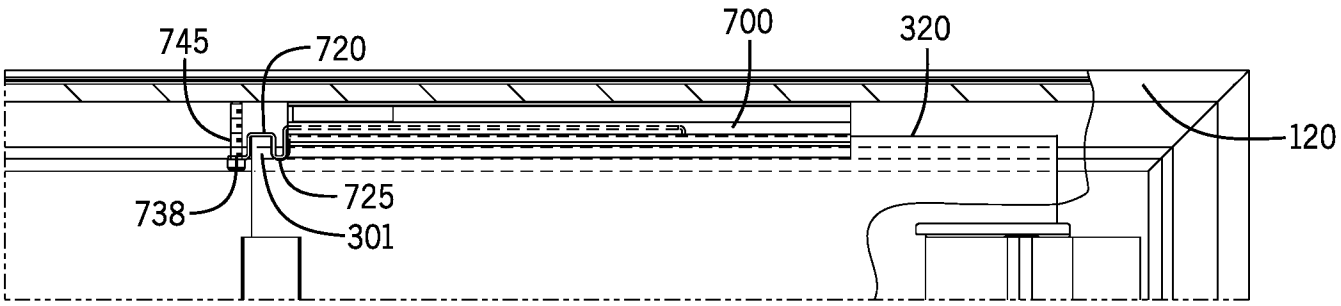
FIG. 30 is a view the panel in the upper frame section with the panel support engaged to the panel.

In FIG. 30, the panel support 700 is engaged to the top edge 320 of the panel 300. The screw 745 is tightened sufficiently such that the end of the screw 745 contacts an upper surface 217 of the channel 215, which holds the tab 725 of the holding member 720 engaged with the notch 369 in the top edge 320 of the panel 300. The panel support 700 is locked to the top edge 320 of the panel 300.

Figure 31:
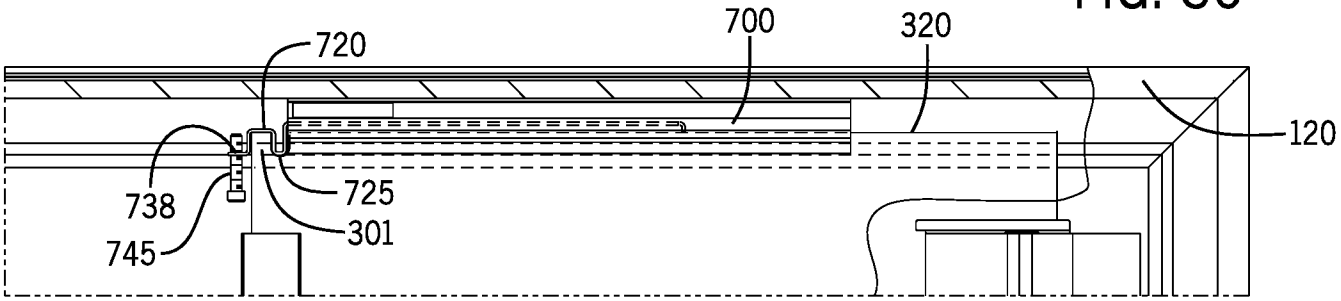
FIG. 31 is a view the panel in the upper frame section with the screw of the panel support untightened.

In FIG. 31, the screw 745 is untightened sufficiently such that the end of the screw 745 has withdrawn. The end portion 735 of the holding member 720 is now free to be flexed.

Figure 32:
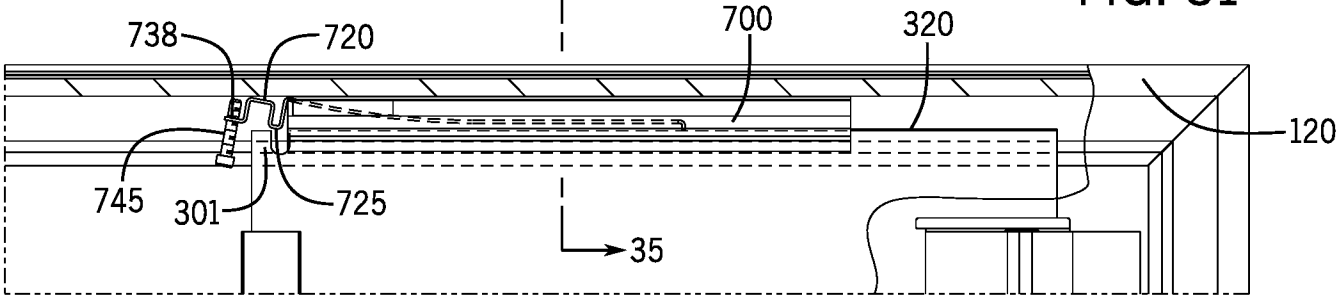
FIG. 32 is a view the panel in the upper frame section with the tab removed and the holding member flexed.
Figure 35:
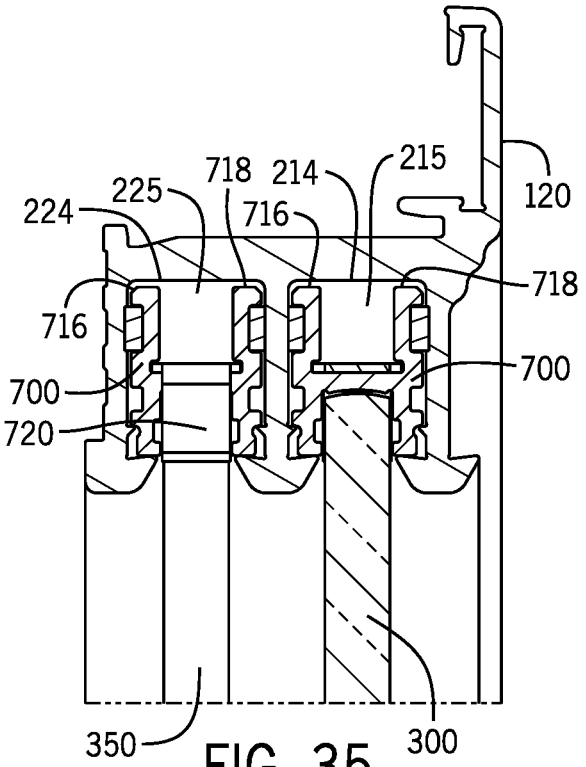
FIG. 35 is a sectional view the panel engaged to the panel support in the upper frame section.

In FIG. 32, the end portion 735 of the holding member 720 is flexed upward and the tab 725 of the holding member 720 is disengaged from the notch 369 in the top edge 320 of the panel 300. The panel support 700 is now unlocked from the top edge 320 of the panel 300, but is still engaged to the top edge 320. FIG. 35 shows a cross-section of the panel 300 engaged to the panel support 700.

Figure 33:
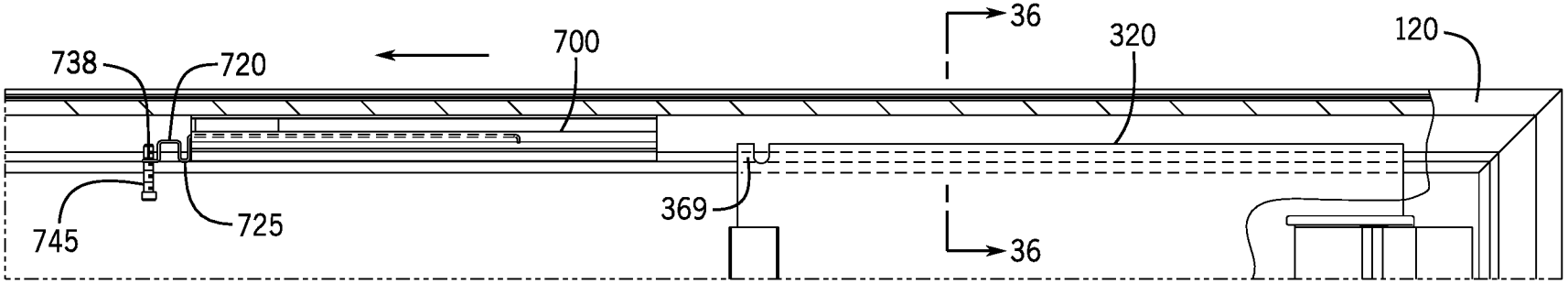
FIG. 33 is a view the panel in the upper frame section with the support moving to the right.
Figure 34:
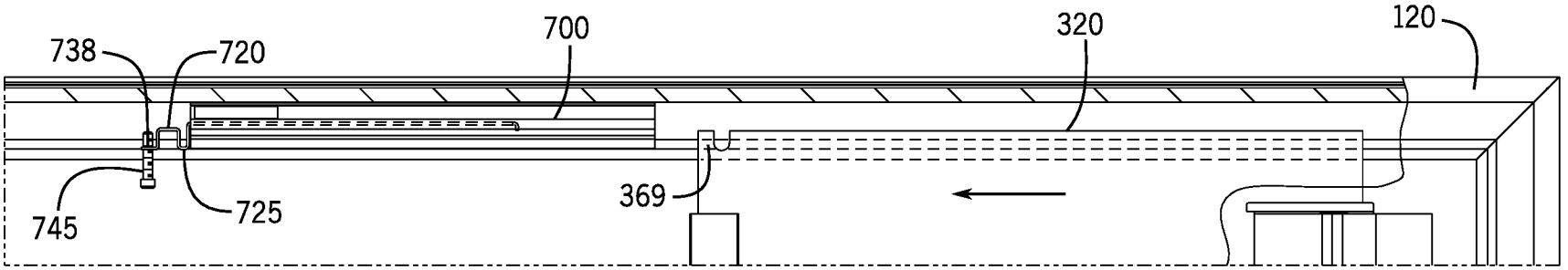
FIG. 34 is a view the panel in the upper frame section with the panel support moved to the right and the holding member at a relaxed state.
Figure 36:
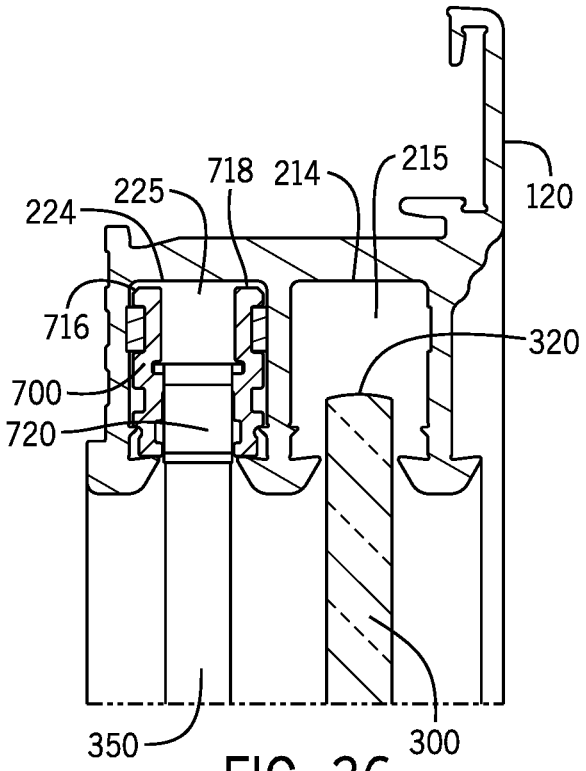
FIG. 36 is a view the panel in the upper frame section with the panel support moved.

In FIG. 33, the panel support 700 is moved to the right of the panel 300. The panel support 700 is no longer engaged to the panel 300. The panel support 700 is still held in the channel 215. The panel 300 is still held in the frame 100 by the panel support 700 in the channel 210 in the lower frame section 120. The weight of the panel 300 is resting on the panel support 700 in the channel 210 in the lower frame section 120. The panel 300 is now free to move upward until the panel contacts an upper surface 214 of the channel 216. FIG. 36 shows a cross-section of the upper frame section 120 after the panel support 700 is moved to the right of the panel 300.

Figure 37:
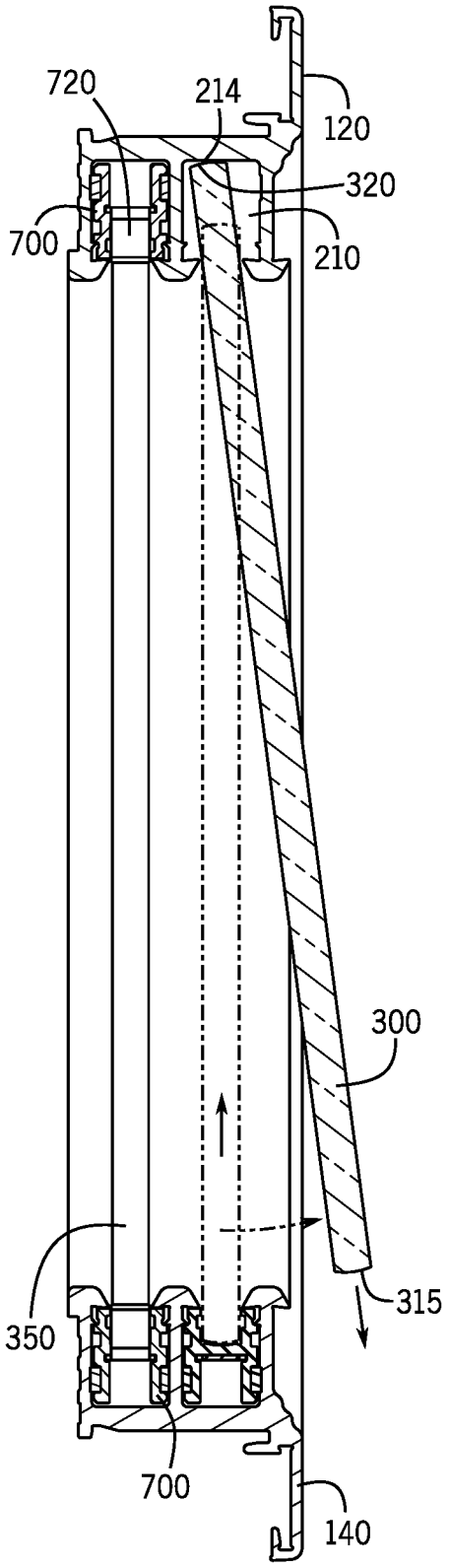
FIG. 37 is a view the panel moved upward and tiling from the frame.

After the panel support 700 is moved to the right of the panel 300, the panel 300 is now free to be removed from the frame 100. As shown in FIG. 36, with the panel support 700 moved, there is now an open space above the top edge 320 of the panel 300 in the channel 215. As shown in FIG. 37, the panel 300 is lifted upward, further into the channel 215, and the bottom edge 315 of the panel 300 is pulled upward from the panel support 700 in the lower frame section 120. Now, as shown in FIG. 37, the user may rotate the bottom of the panel 300 outward—with the bottom edge 315 passing over the panel support 700 in the lower frame section 140. The panel 300 may now be lowered for complete removal of the panel 300 from the frame 100.

Figure 38:
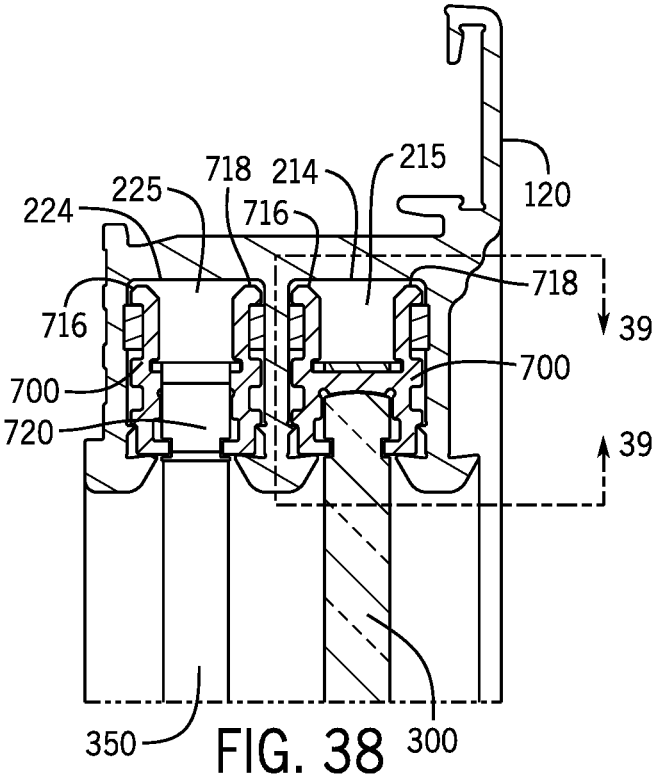
FIG. 38 is a sectional view showing the engagement of the projections and grooves.
Figure 39:
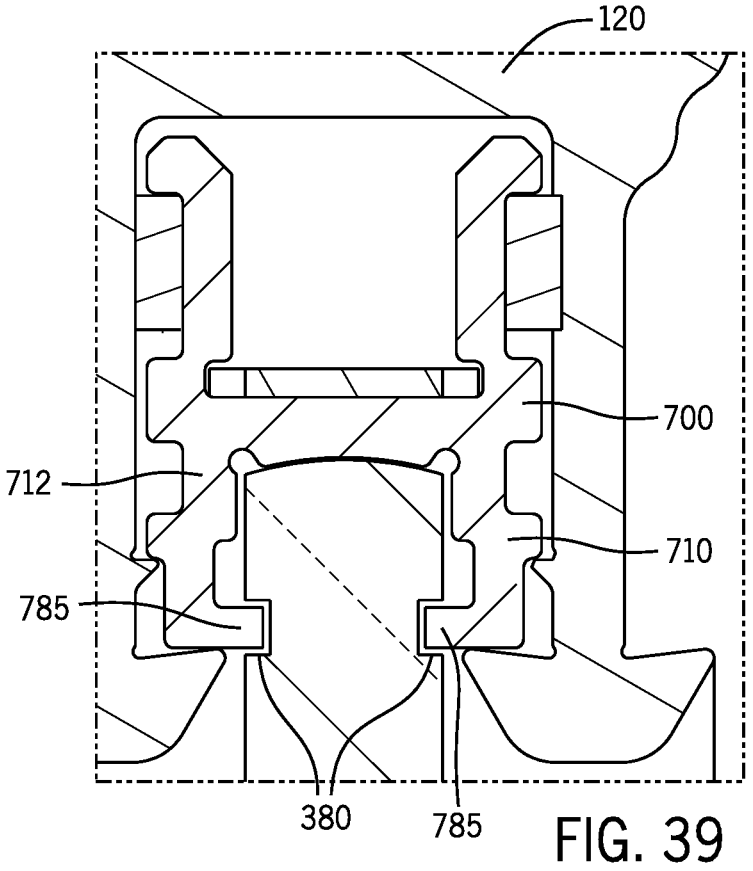
FIG. 39 is an enlarged sectional view showing the engagement of the projections and grooves.

Turning now to FIGS. 38 and 39, an optional aspect of the present disclosure is illustrated. In this aspect, the panel 300 includes grooves 380 extending from the forward leading edge 305 to the rear leading edge 310 of the panel. The grooves 380 are proximate or spaced closely to the top edge 320. The grooves 380 are generally parallel to the top edge 320 of the panel 300.

The sidewalls 710 and 712 of the panel support 700 define the first central channel 703 that receives the top edge 320 of the 300 panel. In this aspect, the sidewalls 710 and 712 further include projections 785 that extend inwardly or into the first central channel 703. When the panel 300 is properly aligned with the panel support 700, the grooves 380 receive the projections 785 in a locking engagement. If the panel support 700 in the lower frame section 140 is removed first, the engagement of the grooves 380 to the projections 785 will support or hold the panel 300. This engagement between the grooves 380 and the projections 785 may improve durability and safety during a collision or other impact. This engagement between the grooves 380 and the projections 785 helps to further hold the panel 300 to the frame 100.

As such, it should be understood that the disclosure is not limited to the particular aspects described herein, but that various changes and modifications may be made without departing from the spirit and scope of this novel concept as defined by the following claims. Further, many other advantages of applicant's disclosure will be apparent to those skilled in the art from the above descriptions and the claims below.

What is claimed is:

1. A frame assembly with sliding panels, comprising:

a frame comprising an upper section opposite of a lower section;

the lower section of the frame defining a first lower channel and a second lower channel;

the upper section of the frame defining a first upper channel and a second upper channel;

a first sliding panel comprising a first lower edge, a first panel support removably engaged to the first lower edge; the first lower edge positioned in a first central channel of the first panel support; wherein the first panel support includes a first holding member positioned in a second central channel of the first panel support and the first holding member engages to the first sliding panel; wherein the first panel support slides in the first lower channel, the first sliding panel comprising a first upper edge, a second panel support removably engaged to the first upper edge; the first upper edge positioned in a first central channel of the second panel support; wherein the second panel support includes a second holding member positioned in a second central channel of the second panel support and the second holding member engages to the first sliding panel; wherein the second panel support slides in the first upper channel, a second sliding panel comprising a second lower edge, a third panel support removably engaged to the second lower edge; the second lower edge positioned in a first central channel of the third panel support; wherein the third panel support includes a third holding member positioned in a second central channel of the third panel support and the third holding member engages to the second sliding panel; wherein the third panel support slides in the second lower channel; and, the second sliding panel comprising a second upper edge, a fourth panel support removably engaged to the second upper edge; the second upper edge positioned in a first central channel of the fourth panel support; wherein the fourth panel support includes a fourth holding member positioned in a second central channel of the fourth panel support and the fourth holding member engages to the second sliding panel; wherein the fourth panel support slides in the second upper channel.

2. The frame assembly with sliding panels according to claim 1, wherein the first and second sliding panels are disengaged from the panel supports for removal of the first and second sliding panels from the frame.

3. The frame assembly with sliding panels according to claim 1, wherein the first holding member includes a first tab that engages with a first notch in the first lower edge of the first sliding panel, and wherein the second holding member includes a second tab that engages with a second notch in the first upper edge of the first sliding panel.

4. The frame assembly with sliding panels according to claim 3, wherein the first notch is formed proximate to a first corner of the first sliding panel, and wherein the second notch is formed proximate to a second corner of the first sliding panel.

5. The frame assembly with sliding panels according to claim 4, wherein the first sliding panel is disengaged from the first and second panel supports by pressing on the first holding member to disengage the first tab from the first notch and by pressing on the second holding member to disengage the second tab from the second notch.

6. The frame assembly with sliding panels according to claim 1, wherein the first holding member includes a first tab that biases into a first notch in the first lower edge of the first sliding panel, and wherein the second holding member includes a second tab that biases into a second notch in the first upper edge of the first sliding panel.

7. The frame assembly with sliding panels according to claim 1, wherein the holding members are a leaf spring or a biasing member.

8. A frame assembly with sliding panels, comprising:

a frame comprising an upper section opposite of a lower section;

the lower section of the frame defining a first lower channel and a second lower channel;

the upper section of the frame defining a first upper channel and a second upper channel;

a first sliding panel comprising a first lower edge, a first panel support removably engaged to the first lower edge; wherein the first panel support includes a first holding member that engages to the first lower edge; wherein the first panel support slides in the first lower channel, the first sliding panel comprising a first upper edge, a second panel support removably engaged to the first upper edge; wherein the second panel support includes a second holding member that engages to the first upper edge; wherein the second panel support slides in the first upper channel, a second sliding panel comprising a second lower edge, a third panel support removably engaged to the second lower edge; wherein the third panel support includes a third holding member that engages to the second lower edge; wherein the third panel support slides in the second lower channel;

the second sliding panel comprising a second upper edge, a fourth panel support removably engaged to the second upper edge; wherein the fourth panel support includes a fourth holding member that engages to the second upper edge; wherein the fourth panel support slides in the second upper channel; and wherein the first holding member includes a first tab that biases into a first notch in the first lower edge of the first sliding panel, wherein the first tab transitions into a first concave portion that receives a first corner of the first lower edge of the first panel, wherein the second holding member includes a second tab that biases into a second notch in the first upper edge of the first sliding panel, and wherein the second tab transitions into a second concave portion that receives a second corner of the first upper edge of the first panel.

9. The frame assembly with sliding panels according to claim 1, wherein the first holding member and the second holding member lockingly engage to the first sliding panel, and the third holding member and the fourth holding member lockingly engage to the second sliding panel.

10. A frame assembly with a sliding panel, comprising:

a frame comprising an upper section opposite of a lower section;

the lower section of the frame comprising a lower channel;

the upper section of the frame comprising an upper channel;

a sliding panel comprising a lower edge and an upper edge;

a panel support comprising a holding member that removably engages to the panel; wherein the holding member is a leaf spring or a biasing member; wherein the lower edge of the panel or the upper edge of the panel is positioned in a first central channel of the panel support, wherein a portion of the holding member is positioned in a second central channel of the panel support, and, wherein the panel support slides in the upper channel or the lower channel.

11. The frame assembly with a sliding panel according to claim 10, wherein the holding member includes an end portion and a tab that biases into a notch in the lower edge or the upper edge of the sliding panel, and wherein pressing on the end portion withdraws the tab from the notch.

12. The frame assembly with a sliding panel according to claim 10, wherein the holding member includes a tab that biases into a notch in the lower edge or the upper edge of the sliding panel, wherein the tab transitions into a concave portion that receives a corner of the lower edge or upper edge of the sliding panel.

13. The frame assembly with a sliding panel according to claim 10, wherein the holding member includes a catch, wherein the holding member is attached to the panel support by the catch engaging to an opening in the panel support.

14. The frame assembly with a sliding panel according to claim 10, wherein the panel support includes a first sidewall and a second sidewall, and the first and second sidewalls define the first central channel and the second central channel.

15. The frame assembly with a sliding panel according to claim 14, wherein the first and second sidewalls further include projections that extend inwardly or into the first central channel and the second central channel, wherein the sliding panel comprises grooves, and the grooves engage the projections.

16. The frame assembly with a sliding panel according to claim 10, wherein the panel support includes first and second sidewalls, the first and second sidewalls define the first and second central channels, the first and second sidewalls includes edges that slide against the upper channel or the lower channel.

17. The frame assembly with a sliding panel according to claim 10, wherein the panel support includes first and second sidewalls and a central wall, the first and second sidewalls define the first and second central channels, the first and second central channels are generally parallel, and the first and second central channels are on opposite sides of the central wall.

18. A frame assembly with a sliding panel, comprising:

a frame comprising an upper section opposite of a lower section;

the lower section of the frame comprising a lower channel;

the upper section of the frame comprising an upper channel;

a sliding panel comprising a lower edge and an upper edge;

a panel support comprising a holding member that removably engages to the lower edge or the upper edge of the panel; and, wherein the panel support slides in the upper channel or the lower channel wherein the holding member includes an end portion and a tab that biases into a notch in the lower edge or the upper edge of the sliding panel, wherein pressing on the end portion flexes the holding member to withdraw the tab from the notch, wherein the end portion includes a threaded opening that receives a screw, and where the screw is configured to thread into the threaded opening to a position that prevents the holding member from flexing.

19. A frame assembly with a sliding panel, comprising:

a frame comprising an upper section opposite of a lower section;

the lower section of the frame comprising a lower channel;

the upper section of the frame comprising an upper channel;

a sliding panel comprising a lower edge and an upper edge; and, a panel support comprising:

a central wall;

a first sidewall generally perpendicular to the central wall;

a second sidewall generally perpendicular to the central wall;

the first and second sidewalls define a first channel configured to receive the lower edge or the upper edge of the sliding panel;

the first and second sidewalls define a second channel; and, a holding member positioned in the second channel, wherein the holding member is a leaf spring or a biasing member, and the holding member engages the sliding panel.

20. The frame assembly according to claim 19, wherein the holding member includes a catch, wherein the holding member is attached to the panel support by the catch engaging to an opening in the panel support.

21. The frame assembly according to claim 19, wherein the holding member includes a tab formed from an integral bend in the holding member, and the tab is generally perpendicular to a length of the holding member.

22. The frame assembly according to claim 19, wherein the first and second sidewalls further include projections that extend inwardly or into the first channel, wherein the projections are configured to engage grooves of a sliding panel.

23. A method of removing a sliding panel from a frame, comprising:

providing the frame with the sliding panel, comprising:

the frame comprising an upper section opposite of a lower section;

the lower section of the frame comprising a lower channel;

the upper section of the frame comprising an upper channel;

the sliding panel comprising a lower edge and an upper edge;

an upper panel support comprising a first holding member that removably engages to the panel; wherein the first holding member is a leaf spring or a biasing member, wherein the upper edge of the panel is positioned in a first central channel of the upper panel support, wherein a portion of the first holding member is positioned in a second central channel of the upper panel support, a lower panel support comprising a second holding member that removably engages to the panel; wherein the second holding member is a leaf spring or a biasing member; wherein the lower edge of the panel is positioned in a first central channel of the lower panel support, wherein a portion of the second holding member is positioned in a second central channel of the lower panel support, wherein the upper panel support slides in the upper channel and the lower panel support slides in the lower channel, and;

disengaging the first holding member of the upper panel support from the panel;

sliding the upper panel support off of the upper edge of the panel;

lifting the panel upward;

tilting a bottom portion of the sliding panel outward from the lower section; and, removing the panel from the frame.

* * * * *